US007463854B2

(12) United States Patent
Nishida et al.

(10) Patent No.: US 7,463,854 B2
(45) Date of Patent: Dec. 9, 2008

(54) DEVELOPING APPARATUS, PROCESSING CARTRIDGE, AND IMAGE FORMING APPARATUS

(75) Inventors: Shinichi Nishida, Mishima (JP); Kazunari Hagiwara, Numazu (JP); Yasushi Shimizu, Suntoh-gun (JP); Katsunori Yokoyama, Susono (JP); Naoto Kichijima, Imizu (JP); Hirokazu Usami, Suntoh-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 39 days.

(21) Appl. No.: 11/764,685

(22) Filed: Jun. 18, 2007

(65) Prior Publication Data

US 2007/0297833 A1 Dec. 27, 2007

(30) Foreign Application Priority Data

Jun. 23, 2006 (JP) ..... 2006-173617
Jun. 23, 2006 (JP) ..... 2006-173618
Jun. 8, 2007 (JP) ..... 2007-152702

(51) Int. Cl.
*G03G 15/06* (2006.01)

(52) U.S. Cl. ..... 399/284; 399/260; 399/274; 399/119; 399/53

(58) Field of Classification Search ..... 399/284, 399/260, 279, 102–105, 274, 53
See application file for complete search history.

(56) References Cited

U.S. PATENT DOCUMENTS 4,742,797 A * 5/1988 Barker ..... 399/105
6,219,505 B1 * 4/2001 Sato et al. ..... 399/98
6,606,474 B2 * 8/2003 Sirejacob ..... 399/274
2007/0098436 A1 * 5/2007 Arakawa ..... 399/103

FOREIGN PATENT DOCUMENTS

JP 02-025866 A 1/1990

* cited by examiner

*Primary Examiner*—David M Gray
*Assistant Examiner*—G.M. Hyder

(57) ABSTRACT

A sheet-shaped regulation member is supported by a supporting unit with an elastic force occurring by bending a sheet-shaped regulation member in the longitudinal direction thereof, and a force received as a result of being pressed by a developing roller. Thus, direct contact can be securely made onto a developer bearing member, and a regulation member can be provided which enables easily attaching thereof to the supporting member, as well as enabling a developing apparatus, processing cartridge, and image forming apparatus, to be reduced in size.

33 Claims, 15 Drawing Sheets

DEVELOPING APPARATUS, PROCESSING CARTRIDGE, AND IMAGE FORMING APPARATUS

BACKGROUND OF THE INVENTION

1. Field of the Invention

The present invention relates to a developing device, a processing cartridge, and an image forming apparatus.

2. Description of the Related Art

Contact developing methods and non-contact developing methods are widely known as currently used developing methods employing monocomponent toner. Specifically, (1) a contact developing method employing a developing roller having an elastic layer, (2) a non-contact developing method with a magnetic toner employing a metal sleeve, and so forth, have been proposed. Regarding these developing methods, several measures have been proposed for a toner regulation member for the purpose of forming a thin layer of monocomponent toner on a developer bearing member.

(1) Contact Developing Method Employing Developing Roller Having Elastic Layer (FIG. 8)

A developing method is well known wherein developing is performed by bearing a non-magnetic developer on a developing roller 3, which is an elastic roller having a dielectric layer, and causing the developer to make contact with the surface of a photosensitive drum 1. Supplying the developer to the developing roller 3 is performed by a supply roller 5, which makes contact with the developing roller 3. The supply roller 5 has a function for transporting the developer from within a developer container T and adhering this to the developing roller 3, as well as removing the developer remaining on the developing roller 3 before subsequent processing.

Layer regulation of the developer adhered to the developing roller 3 and frictional charge applied thereto are performed by causing a toner regulation member 4*c* to make contact with the developing roller 3. A regulation member has been proposed which supports one end side 4*c*1 of a metal thin plate serving as the toner regulation member 4*c*, and wherein the underside of the other end side 4*c*2 makes contact with the developing roller 3. The electrostatic image formed on the photosensitive drum 1 is developed by the developer coated on the developing roller 3 by the toner regulation member 4*c*.

(2) Non-Contact Developing Method With Magnetic Toner Employing Metal Sleeve (FIG. 14)

A non-contact developing method employing a monocomponent toner is widely known, which is performed by employing a cylindrical developing sleeve 3*a*, and the layer regulation of the developer and the frictional charge applied thereto are performed by causing the toner regulation member 4*d* to make contact with the developing sleeve 3*a*. Supplying the developer to the developing sleeve 3*a* is performed magnetically by providing a magnet within the developing sleeve 3*a*.

A DC bias and an AC bias are applied between the developing sleeve 3*a* and a photosensitive drum 1, and developing is performed in a non-contact manner. Even if there is too much toner on the developing sleeve 3*a* with insufficient charge, unnecessary toner development can be suppressed by disposing a magnetic pole in the vicinity of the developing unit. Thus, Japanese Patent Laid-Open No. 02-025866 proposes that the charge amount of the developer on the developing sleeve 3*a* can be set so as to be relatively low, and the toner regulation member 4*d* employs a rubber plate with low contact pressure with consideration for the stability of contact.

However, in the case of employing a blade-shaped toner regulation member with the contact development method (1), a configuration is made wherein a thin elastic member is supported along one side in the longitudinal direction thereof, and the underside of the facing portion thereof makes contact with the developing roller. Accordingly, there has been the problem wherein creating a smaller apparatus has been difficult. That is to say, if the size of the toner regulation member is reduced, the distance between the point of support wherein one side of the thin elastic member is supported, and the point of contact with the developing roller, i.e. the free length, becomes shorter. Thus, the spring constant of the contact pressure increases, and even if the setting position of the toner regulation member varies only a small amount, the contact pressure varies widely. Therefore, highly precise assembly has been necessary in order to set a stable contact pressure.

Also, reduction in length of the free length of the thin elastic member tends to increase the effects of uneven adhesion at the one-side supporting portion, and the difficulty in applying even pressure over the entire lengthwise direction adds to the difficulty in creating a smaller apparatus.

Also, with the non-contact developing method (2) with a magnetic toner, a rubber sheet supported along one side in the longitudinal direction is employed as the toner regulation member. When the state of the rubber sheet is maintained for a long period of time in a deformed shape, it becomes difficult to return the rubber to the shape thereof prior to deforming, whereby so-called creeping occurs. When creeping occurs, the contact pressure varies, and so obtaining a stable contact pressure for a long period of time has been difficult. It has been found desirable to provide for a solution to the above-mentioned problems.

SUMMARY OF THE INVENTION

The present invention is directed to a developing apparatus, a processing cartridge, and an image forming apparatus which enable contact with the developer bearing member of the regulation member in a stable manner. The present invention is also directed to a developing apparatus, a processing cartridge, and an image forming apparatus with improved assembly, of a smaller size, and with improved image quality.

According to an aspect of the present invention, a developing apparatus employed with an image forming apparatus includes a developer bearing member configured to bear developer for developing an electrostatic latent image formed on an image bearing member; a supporting member supporting the developer bearing member; and a sheet-shaped regulation member making contact with the developer bearing member which is supported by a supporting member and configured to regulate the amount of developer borne by the developer bearing member. The sheet-shaped regulation member includes a first contact portion supported at one end side in the width-wise direction of the sheet-shaped regulation member by the supporting member, and the first contact portion having a flat surface portion and an end surface portion intersecting with the flat surface portion, a second contact portion being supported by the supporting member at the other end side in the width-wise direction of the regulation member, and a third contact portion making contact with the developer bearing member between the first contact portion and the second contact portion in the width-wise direction of the regulation member. The flat surface portion makes contact with and is supported by the supporting member by an elastic force generated by the regulation member being bent along the lengthwise direction of the regulation member, or by an elastic force generated by the third contact portion making contact with the developer bearing member. The end surface portion makes contact with and is supported by the supporting member by the force received from the developer bearing member by the third contact portion making contact with the developer bearing member.

According to another aspect of the present invention, a processing cartridge detachably attached to an image forming apparatus includes an image bearing member and the developing apparatus disclosed above.

According to another aspect of the present invention, an image forming apparatus configured to form an image on a recording medium includes an image bearing member and the developing apparatus disclosed above.

Further features of the present invention will become apparent from the following description of exemplary embodiments with reference to the attached drawings.

DESCRIPTION OF THE EMBODIMENTS

First Embodiment

Main Unit Configuration

Figure 2:
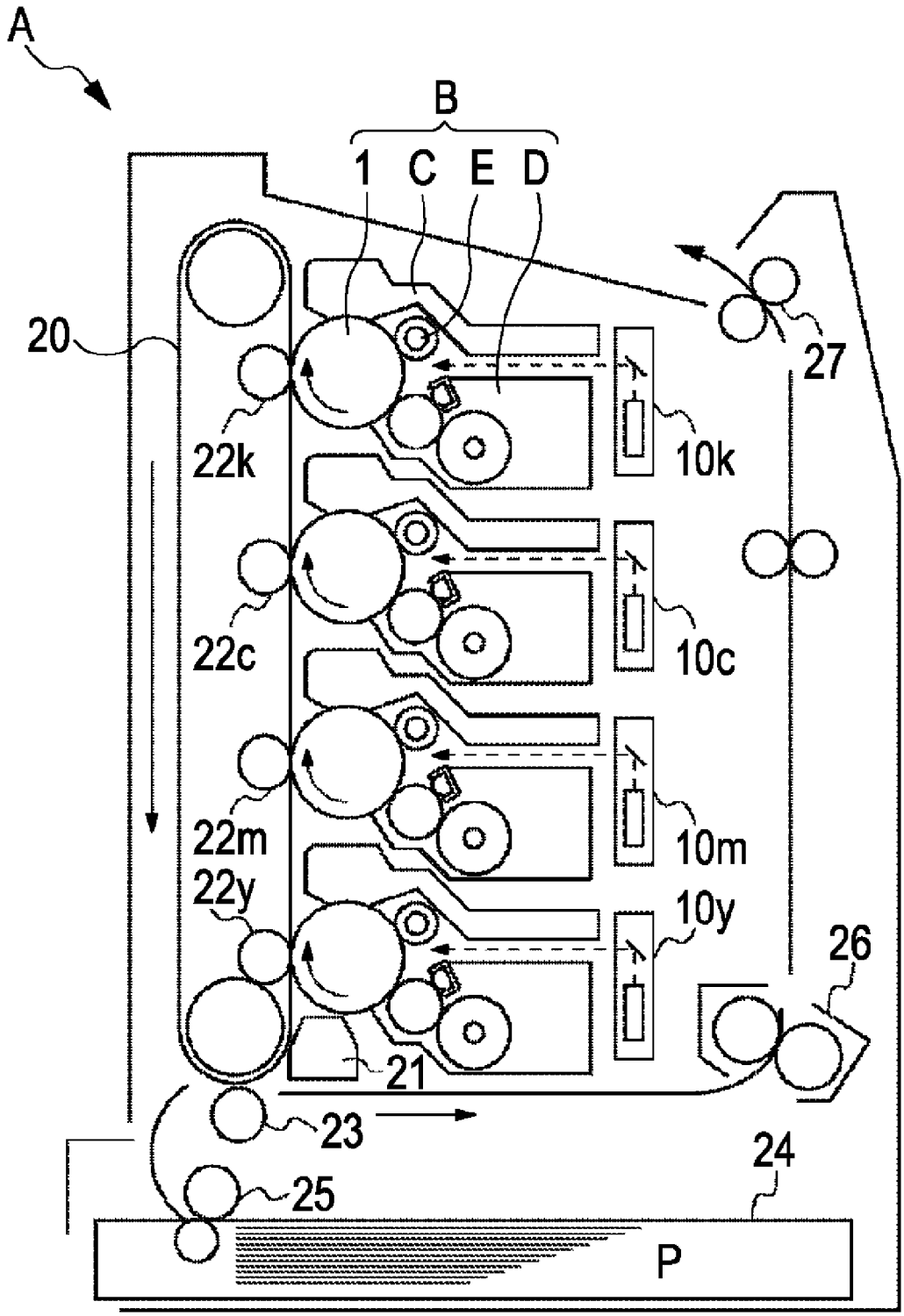
FIG. 2 is a schematic diagram of an image forming apparatus main unit according to the first embodiment.

FIG. 2 is a schematic diagram of an image forming apparatus according to a first embodiment. The present image forming apparatus A is a full-color laser printer for electrophotography processing. A schematic configuration for the overall image forming apparatus A according to the present invention will be described below.

A process cartridge B (hereinafter referred to as cartridge B) is made up of a charging apparatus, a developing apparatus D, a cleaning apparatus C, and a photosensitive drum 1, as an integrated unit. As shown in FIG. 2, the cartridges B of the colors yellow, magenta, cyan, and black, in a row of four, are detachably arrayed in a vertical direction within the image forming apparatus A. The image forming apparatus A forms a full-color image by transferring the toner image formed with the various cartridges B onto an intermediate transferring belt 20 of a transfer apparatus. The image forming process at the cartridge B will be described in detail later.

The toner image formed on the photosensitive drum 1 is transferred to the intermediate transfer belt 20. Primary transfer rollers 22*y*, 22*m*, 22*c*, and 22*k* are provided in facing positions on the photosensitive drum 1 of each color and sandwich the intermediate transfer belt 20. Then the image is transferred to a recording sheet P all at once, with a secondary transfer roller 23 provided on the downstream side in the movement direction of the intermediate transfer belt 20. Note that the toner on the intermediate transfer belt 20 that is not transferred is collected by an intermediate transfer belt cleaner 21.

The recording sheet P is loaded within a cassette 24 in the lower portion of the image forming apparatus A and transported by a supply roller 25 according to a request for printing operation. The toner image, which is formed on the intermediate transfer belt 20, is transferred on the recording sheet P while at the position of the secondary transfer roller 23.

Subsequently, the toner image is fused to the recording sheet with heat by a fusing unit 26, and the recording sheet is discharged to the outside of the image forming apparatus A via a sheet discharge unit 27.

The image forming apparatus A can be separated into an upper unit storing the four colors of cartridges B and so forth, and a lower unit storing the transfer unit, recording medium, and so forth. In the event of a paper jam occurring or the cartridge B being replaced, the upper or lower unit is opened.

Note that with the image forming apparatus A according to the present embodiment, the life of the toner container in the cartridge B is set to approximately 4000 sheets, with a printed surface equivalent to 5% on A4 size paper.

Figure 3:
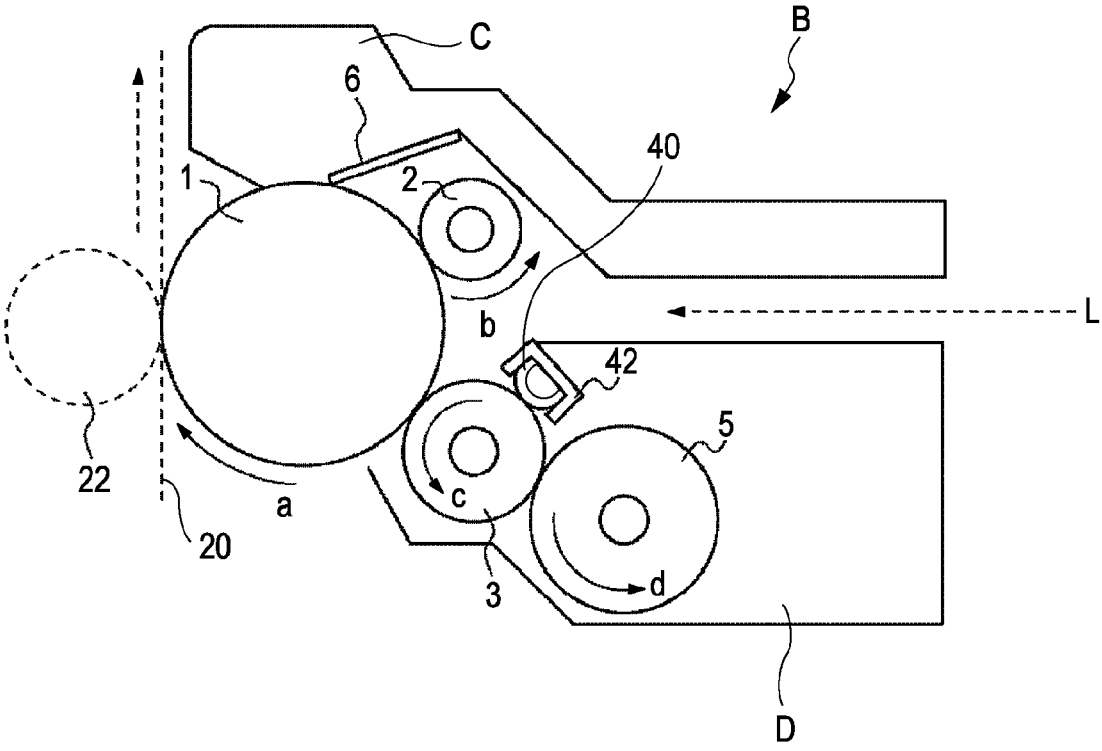
FIG. 3 is a schematic diagram of a processing cartridge according to the first embodiment.

Next, the image forming process with the cartridges B will be described. FIG. 3 focuses on one of the four cartridges B that are in a row and shows the cross-section of the vicinity thereof.

The photosensitive drum 1 can employ an organic photosensitive drum wherein an underlying layer, a carrier generating layer, and a carrier transferring layer, which are functional films, are coated sequentially on the outer periphery of an aluminum cylinder. With the image forming process, the photosensitive drum 1 is driven toward the arrow a in the diagram by the image forming apparatus A at a predetermined speed.

A charging roller 2 provided on the charging apparatus E presses a conductive rubber roller portion onto the photosensitive drum 1 and rotationally drives in the direction of the arrow b. A core of the charging roller 2 has a direct current of −1100V applied thereto in a charging process. The surface potential of the photosensitive drum 1 forms a uniform dark potential (Vd) of −550V by the induced charge.

A spot pattern of laser beam emitted by a scanner unit 10 (10*k*, 10*c*, 10*m*, and 10*y*) and corresponding to image data exposes the light (as shown by arrow L in FIG. 3) to this uniform surface charge distribution surface. Then the surface-charge at the exposed portions is diminished, by the carrier from the carrier generating layer, and the potential thereof is reduced. Consequently, an electrostatic latent image (the exposed portions have a bright potential of V1=−100V and the non-exposed portions have a dark potential of Vd=−550V) is formed on the photosensitive drum 1 serving as the image bearing unit.

The electrostatic latent image is developed by the developing apparatus D having the toner coating layers formed on the developing roller 3 with a predetermined coating amount and charge amount. The developing roller 3 of the developing apparatus D rotates in the forward direction as indicated by an arrow c while making contact with the photosensitive drum 1. Then the toner, which is negatively charged by a frictional charge, as to the DC bias=−350V applied to the developing roller 3, flies only to the bright potential portions from the potential difference at the developing unit in contact with the photosensitive drum 1, and the electrostatic latent image is realized.

The intermediate transfer belt 20 is pressed to the photosensitive drum 1 by the primary transfer rollers 22*y*, 22*m*, 22*c*, and 22*k* that face the photosensitive drum 1. Also, direct current voltage is applied to the primary transfer rollers 22*y*, 22*m*, 22*c*, and 22*k*, and an electrical field is formed between the primary transfer rollers and the photosensitive drum 1. Thus, the toner image realized on the photosensitive drum 1 receives force from the electrical field in a transfer region of pressure contact as mentioned above, and is transferred from the photosensitive drum 1 to the intermediate transfer belt 20. On the other hand, the toner not transferred and remaining on the photosensitive drum 1 is scraped from the drum surface by a cleaning blade 6 made of urethane rubber installed on the cleaning apparatus C, and thus is stored within the cleaning apparatus C.

Figure 1:
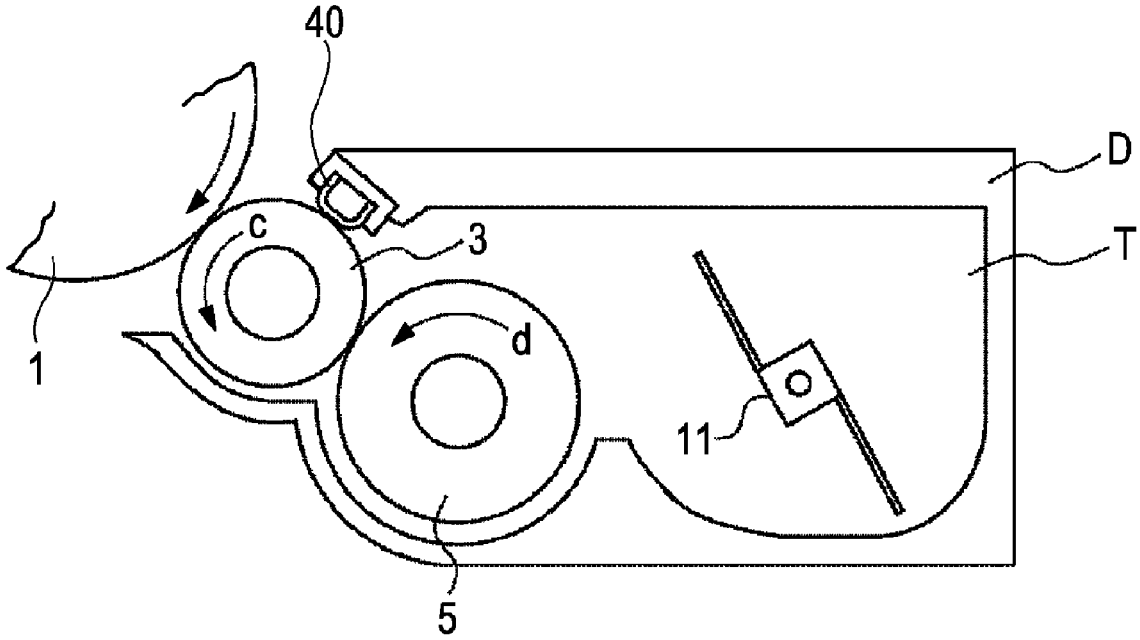
FIG. 1 is a schematic diagram of a developing apparatus according to a first embodiment.

The developing apparatus employed for the present first embodiment will now be described in detail. FIG. 1 shows the developing apparatus D employing a regulation member 40 of the first embodiment to be described below. The developing apparatus D includes a developer container for storing toner T, a developing roller 3 serving as a developer bearing member, a toner supply roller 5, and a stirring member 11 for stirring the toner T. The developing roller 3 rotates in the forward direction as indicated by arrow c while making contact with the photosensitive drum 1. The toner supply roller 5 rotates in the reverse direction d while making contact with the developing roller 3.

With the present embodiment, for the developing roller 3, an elastic roller with a diameter of 12 mm, wherein a 3 mm conductive elastic layer is formed on a core with a diameter of 6 mm, is being employed. For the elastic layer, a silicone rubber with a volume resistance value of $10^6$ Ωm is used. Note that a coating layer or the like having a charge depositing function to the developer may be provided on the surface layer of the elastic roller. With the present embodiment, in order to elastically make contact with the photosensitive drum 1 in a stable manner, the hardness of the elastic layer should be 45° for JIS-A. Also, the surface roughness of the developing roller 3 may depend on the granule diameter of the toner used, but should have a coarseness of 3 μm to 15 μm Rz at ten-point mean roughness. If the toner granules used have an average volume granule diameter of 6 μm, the ideal ten-point mean roughness thereof would be between 5 μm and 12 μm Rz. The ten-point mean roughness Rz employs a definition specified by JIS B 0601, and for the measurement thereof uses the surface roughness tester "SE-30H" manufactured by Kosaka Laboratory.

Also, with the present embodiment, for the supply roller 5, an elastic sponge roller is employed with a diameter of 16 mm in which a comparatively low-hardness polyurethane foam of 5.5 mm is formed with a foaming structure on top of a core with a diameter of 5 mm. By configuring the supply roller 5 with an interconnected cell foam, the supply roller 5 can make contact with the developing roller 3 without great force being applied. Then, supplying the toner on the developing roller 3 with appropriate unevenness on the foam surface, and scraping the remaining unused toner at the time of developing is performed. The cell structure having the scrapability is not restricted to being formed of urethane foam, but rather, rubber such as a silicone rubber or ethylene-propylene-diene rubber (EPDM rubber) or the like is foamed may be used.

Also, the process cartridge B has a toner regulation member 40 which makes contact with the developing roller 3 at the downstream side of the supply roller 5 as the developing roller rotates in the rotation direction c, and in preparation for developing, regulates the amount of developer. The toner regulation member 40 controls the coating amount of the toner on the developing roller 3 to a predetermined amount and the charge amount to be a predetermined amount appropriate for developing on the photosensitive drum 1. The toner regulation member 40 will be described in detail with the embodiments and comparative examples to be described below.

First, various examples and comparative examples applying the first embodiment will be described below in order to clarify the advantages of the present invention according to the first embodiment.

First Embodiment

The toner regulation member 40 of the present embodiment will be described. FIG. 6C shows the state of the toner regulation member 40 of the present embodiment, which is maintained in a U-shape, prior to making contact with the developing roller 3. As shown in FIG. 6C, the toner regulation member (hereinafter called "regulation member") 40 of the present embodiment is in a flexible sheet shape. The regulation member 40 is supported by a sheet holding member 42 serving as a supporting portion. Now, the regulation member 40 is formed into a U-shape by bending in the widthwise direction, over the entire lengthwise direction. Now, the end portion on one end side of the widthwise direction of the regulation member 40, which is at the downstream side relative to the developing roller rotation direction, is the to be a "first contact portion 47". Now, the first contact portion 47 is configured with a first flat surface portion 47*a* in a planar shape on the end portion of the sheet member in the widthwise direction thereof, and an end face portion 47*b* that intersects with the first flat surface portion 47*a*. The first flat surface portion 47*a* is pressed to make contact with a sheet supporting portion 48 on the inner wall of the recessed portion of the sheet holding member 42. The reason that pressure force works is that the elastic force F-1 acts, wherein the regulation member 40 attempts to revert back from the state of being subjected to bending in the widthwise direction along the lengthwise direction. Also, in order for the elastic force F-1 to act in a sure manner, the regulation member 40 is configured with the planar shaped first flat surface portion 47*a* of the first contact portion 47. Therefore, even in a state wherein the developing roller 3 is not attached, the regulation member 40 can be supported in a stable manner by the recessed sheet holding member 42, even without being glued, or with only a portion of the sheet member in the lengthwise direction glued. However, with the first embodiment, the first contact portion and the later-described second contact portion are supported without being glued.

Next, a second contact portion 49 that is on the other end side in the widthwise direction of the first contact portion 47 (the upstream side relative to the developing roller rotation direction) of the regulation member 40 will be described. With the present first embodiment, as with the first contact portion, the second contact portion 49 is made up of a second flat surface portion 49*a* in a planar shape on the end portion of the sheet member in the widthwise direction thereof, and an end face portion 49*b* that intersects with the second flat surface portion 49*a*. Also, since the regulation member 40 is formed in a U-shape, the second flat surface portion 49*a* of the second contact portion is pressed to make contact with the sheet supporting unit 48 from the elastic force F-1, as with the first flat surface portion 47*a* of the first contact portion. Therefore, the regulation member 40 can be supported in a stable manner by the sheet holding member 42, even if the first contact portion and the second contact portion are not adhered thereto.

Figure 6A:
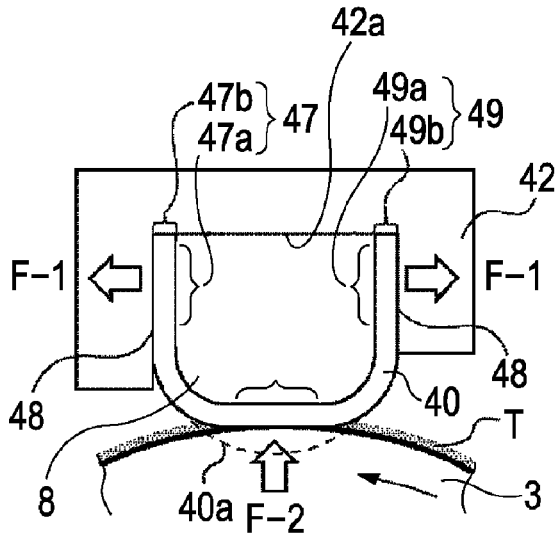
FIGS. 6A-6C are schematic diagrams of a toner regulation member according to the first embodiment.

Next, FIG. 6A shows a state wherein the developing roller 3 is subjected to contact with the regulation member 40 held in a U-shape with a predetermined pressing amount.

A third contact portion 46 which makes contact with the regulation member 40 and the developing roller 3 will be described. The third contact portion 46 is set to be positioned between the first contact member 47 and the second contact member 49 which are on both end portions of the sheet member 30 in the widthwise direction thereof. Then, when the developing roller 3 is pressed in as to the regulation member 40 which is supported in a U-shape, the third contact portion 46 receives pressure force F-2 from the developing roller. At the same time as the pressure force F-2 being received, both end portions of the regulation member 40 in the widthwise direction thereof attempt to spread in the same direction as the elastic force F-1 which attempts to revert from the state wherein the regulation member 40 is subjected to bending into a U-shape. That is to say, as a result of the force being applied in the direction of F-1, the regulation member 40 is supported as to the flexible sheet holding member (hereafter called holding member) 42, with further stability.

Further, with the third contact portion 46, the developing roller 3 is pressed in as to the regulation member 40 which is supported in a U-shaped. Then the end face portion 47*b* of the first contact portion 47 is subjected to making contact surely to the inner wall face 42*a* of the recessed portion of the holding member 42, and the position thereof is regulated in a predetermined position.

Also, with the third contact portion 46, the developing roller 3 is pressed further in as to the regulation member 40 which is supposed in a U-shape. Then the regulation member 40 is deformed to follow along the circumferential surface of the developing roller 3 as to a space 8 which is defined as the inner portion of the U-shape. That is to say, in the state wherein the regulation member 40 and the developing roller 3 are in contact, the curvature 40*a* of the flexible sheet in the state of the regulation member 40 and the developing roller 3 not in contact is changed. Thus, by deforming the regulation member 40, elastic force is generated, and contact pressure can be secured in a stable manner to control the toner amount on the developing roller 3.

In the first embodiment, the regulation member 40 can be a urethane rubber with a hardness of 70° with JIS-A, and the sheet member mentioned above which has a thickness of 0.4 mm and a widthwise length of 14.2 mm is received in the recessed portion of the holding member 42 having a width of 6.0 mm. Thus, the U-shape is formed. With the present embodiment, a urethane rubber is used, but similar advantages can by obtained by using a rubber elastic body such as silicone rubber, NBR rubber, or the like. The contact condition for the regulation member 40 and the developing roller 3 is that the amount to be pressed in, which is the ideal overlap amount of the tip position of the regulation member 40 and the surface of the developing roller 3, is to be 0.5 mm. Thus, the set value of contact pressure (the linear pressure in the bus bar direction of the developing roller) is set to be 30N/m.

The generally used measurement method for contact pressure is a pressure sensor in a thin sheet shape (for example, Prescale film manufactured by Fuji Film Corporation or the like). With the present embodiment, the contact pressure is low, and measurement is difficult with a general pressure sensor. Therefore, measurement of the contact pressure is performed by layering together three layers of hard H material of SUS 304 stainless steel with a thickness of 20 μm, inserting this at the contact portion of the sheet member and developing roller 3, pulling out a thin plate from the center of the contact face in the linear direction of contact with a spring scale, and measuring the pullout force thereof. Thus, the measurement of contact pressure is obtained from the proof value and contact width from the pullout pressure measurement in the event of a known load being placed on the pressure measurement tool.

Figure 6B:
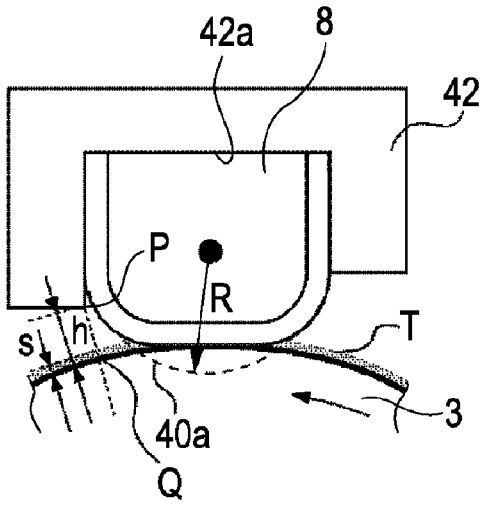
Figure 6C:
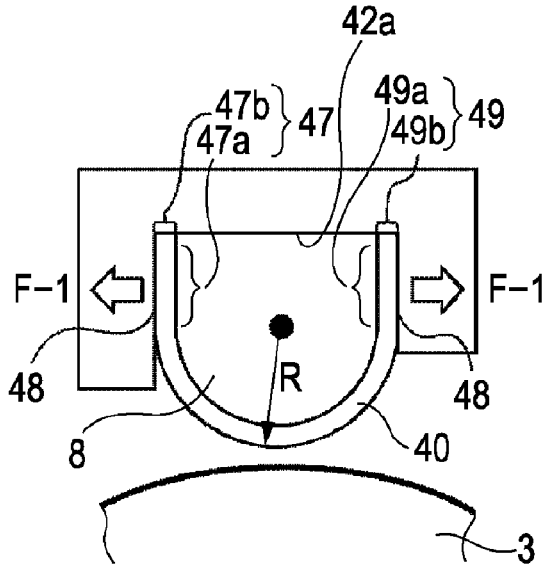

Also, with the present embodiment, the wall height of the holding member 42 on the downstream side as to the rotation direction of the developing roller 3 is set to within the range of $S<h<0.8\times R$. As shown in FIG. 6B, S is the thickness of the toner coating later (developer layer) on the developing roller after the toner is regulated, and h is the shortest distance from the inner wall on the downstream side to the surface of the developing roller. In FIG. 6B, h indicates the distance between the points P and Q. R is the curvature radius at the curvature portion which is formed when the sheet member is bent in the widthwise direction along the lengthwise direction, and the R value refers to the state wherein the first contact portion is separated.

Specifically, with the present embodiment, the width of the recessed portion of the holding member 42 is 6.0 mm, and the curvature radius R wherein the regulation member 40 is bent in a U-shape is approximately 3.0 mm. Also, the thickness of the toner coating layer is 30 μm. Thus, the wall height of the holding member 42 on the downstream side with respect to the rotation direction of the developing roller 3 is set so that the distance h at the portion most closely approaching the developing roller surface is 1.5 mm. By arranging a configuration for the above-mentioned setting value, the assembly of the regulation member 40 and the image quality can be improved. The reasons thereof will be described later.

Second Embodiment

Figure 7A:
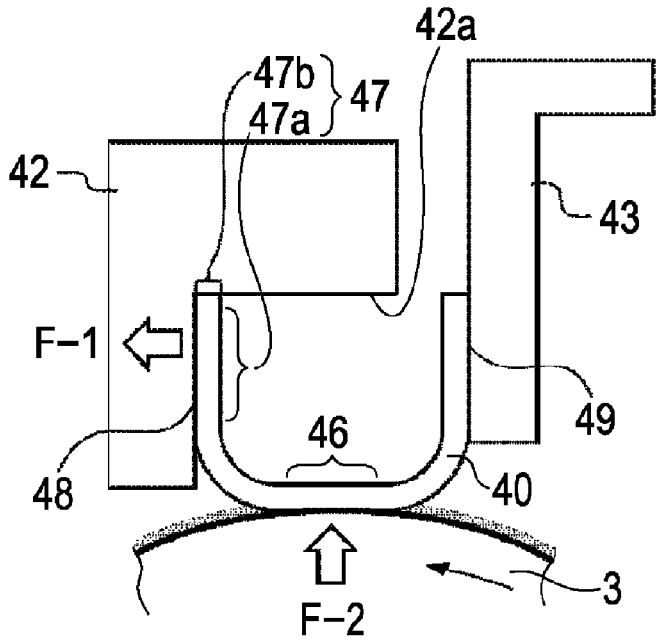
FIGS. 7A and 7B are schematic diagrams of a toner regulation member of the first embodiment.

The regulation member 40 according to the present embodiment is basically the same as the first embodiment, but the configuration thereof differs with the following points. First, as shown in FIG. 7A, the regulation member 40 has a second contact portion 49 wherein the regulation member 40 is fixedly supported by gluing or the like at the upstream side of the developing roller 3 in the rotation direction thereof. Next, the sheet holding member 42*a* serving as a supporting unit to support the flexible sheet is set on the downstream side of the developing roller 3 in the rotation direction thereof. Also, the holding member 42*a* and the supporting member 43, which fixedly supports the upstream side, are configured so as to be capable of separating from one another. Therefore, processing for fixedly supporting the regulation member 40 can be independently performed on the supporting member 43 at the upstream side, and so influence of glue unevenness and so forth can be minimized.

As to the specific supporting method, the regulation member 40 forms the second contact portion by fixedly supporting a steel plate serving as the supporting member 43 via an adhesive layer, as shown in FIG. 7A. Conversely, on the downstream side of the developing roller 3 in the rotational direction thereof, as with the first embodiment, the elastic force F-1 of the regulation member 40 attempting to revert from the state of being bent in the widthwise direction along the lengthwise direction acts upon the flexible sheet supporting region 48. Then the first contact portion 47 makes contact with the first flat surface portion 47*a*, thus being held by the holding member 42*a* in a sure manner.

Also with the third contact portion 46, the developing roller 3 is pressed into the regulation member 40 which is supported in a U-shape. Then, pressure force F-2 acts upon the third contact portion 46. The end face portion 47*b* of the first contact portion 47 of the regulation member 40 makes contact with the recessed portion inner wall bottom face 42*a* of the holding member 42 in a sure manner, and the position of the third contact portion 46 is regulated to a predetermined position.

Third Embodiment

Figure 7B:
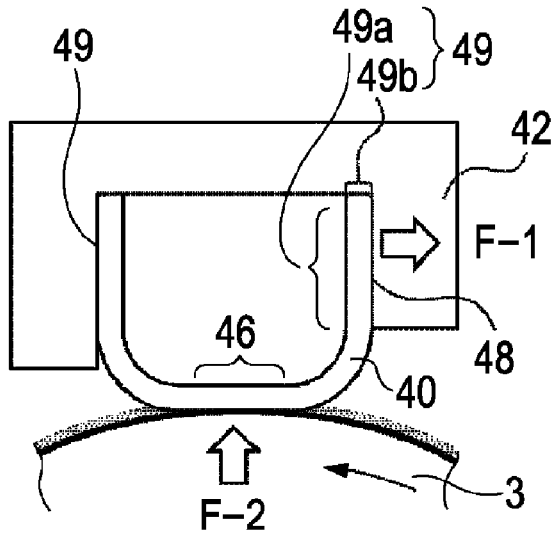

The regulation member 40 according to the third embodiment is basically the same as the first embodiment, but the configuration thereof differs with the following points. First, as shown in FIG. 7B, the point differs wherein the regulation member 40 is fixedly supported with glue or the like at the downstream side of the developing roller 3 in the rotational direction thereof. Also, the supporting unit 42 differs in being formed as an integrated unit with the developer container. Therefore, the assembly process can be made simpler and the size of the apparatus can be reduced.

As to the specific supporting method, the regulation member 40 forms the second contact portion 49 by fixedly supporting the inner wall face of the recessed portion of the holding member 42 at the end portion of the lengthwise direction on the downstream side of the developing roller 3 in the rotational direction thereof, via a glue layer, as shown in FIG. 7B. Conversely, the upstream side of the developing roller 3 in the rotational direction thereof serves as the first contact portion 47. As with the first embodiment, the elastic force F-1 of the regulation member 40 attempting to revert from the state of being along the lengthwise direction acts upon the first flat surface portion 47*a* of the first contact portion. Then the second contact portion 49 makes secure contact with the flexible sheet supporting region 48 of the inner wall of the recessed portion of the holding member 42.

Also with the third contact portion 46, the developing roller 3 is pressed into the regulation member 40 which is supported in a U-shape. Then, the pressure force F-2 acts upon the third contact portion 46, and the end face portion 47*b* of the first contact portion 47 in the widthwise direction at the upstream side of the regulation member 40 securely makes contact with the recessed portion inner wall bottom face of the holding member 42, and the position of the third contact portion 46 is regulated to a predetermined position.

COMPARATIVE EXAMPLE 1

The toner regulation member 4*c* of the present comparative example 1 will be described with reference to FIG. 8. The toner regulation member 4*c* of the present comparative example 1 consists of a supporting plate 4*c*1 fixed to the developer container which is supported along one side in the longitudinal direction by a thin plate shaped elastic member 4*c*2 such as a phosphor-bronze plate or a stainless steel plate, and the underside of the facing portion thereof makes contact with the developing roller 3. With the present comparative example, an iron plate with a thickness of 1.2 mm is employed as the supporting plate, with a phosphor-bronze plate with a thickness of 120 μm adhered to the supporting plate serving as the thin plate shaped elastic member 4*c*2. The distance from the one-side supporting portion of the thin plate shaped elastic member 4*c*2 to the contact portion with the developing roller 3, i.e., the free length, is 14 mm, and the amount for the developing roller 3 pressing into the thin plate shaped elastic member 4*c*2 is 1.5 mm.

COMPARATIVE EXAMPLE 2

Figure 9A:
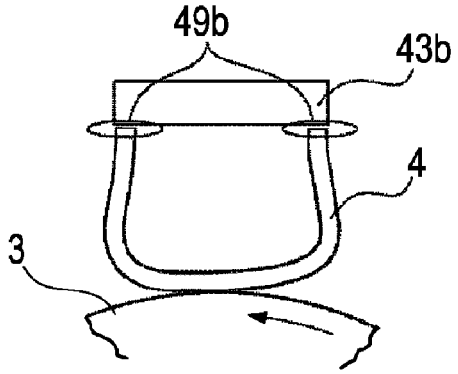
FIGS. 9A and 9B are schematic diagrams of the toner regulation member in a comparative example 2.

The toner regulation member 4 according to the present comparative example is shown in FIG. 9A. With the present comparative example, there is no side face portion of the supporting member to hold the flexible sheet, and so both end faces 49*b* on the sheet member in the widthwise direction are fixed with glue to the supporting member 43*b*.

COMPARATIVE EXAMPLE 3

Figure 10A:
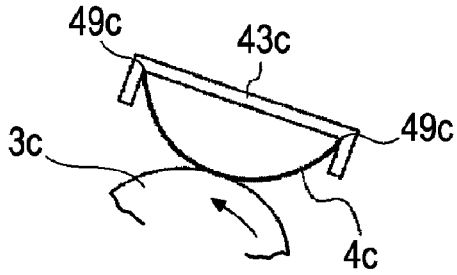
FIGS. 10A-10C are schematic diagrams of the toner regulation member in comparative examples 3 and 4.

The toner regulation member according to the present comparative example is shown in FIG. 10A. The sheet member 4*c* is fixed to both ends 49*c* of the recessed portion bottom face of the supporting member 43*c* so as to bend in the widthwise direction, and the protruding face thus formed makes contact with the developing roller 3*c*.

Here, the point differing from the first embodiment is that there is no first contact portion for making surface contact for the sheet member to be held, or a third contact portion which is deformed along the developing roller and makes contact thereto.

COMPARATIVE EXAMPLE 4

Figure 10B:
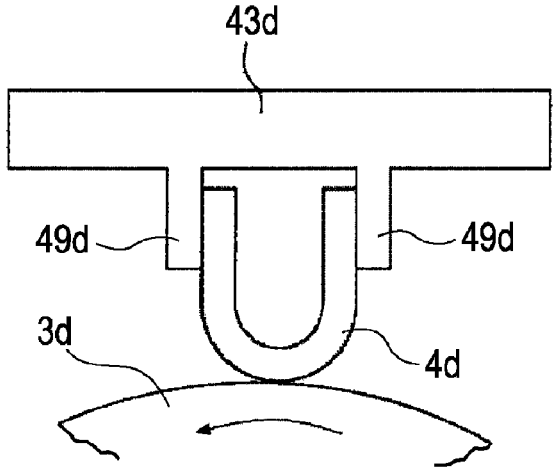

The toner regulation member according to the present comparative example will be described. The toner regulation member of the present comparative example as shown in FIG. 10B has a plate shaped elastic body 4*d* made from rubber or the like subjected to bending toward the developing roller 3*d* side to create a protruding shape, both ends of which are fixed to a fixing portion 49*d* provided on the developing apparatus frame. Contact with the developing roller 3*d* is made at the center of the curved surface which is bent to a protruding shape.

Also, contact with the surface of the developing roller 3*d* is made in a state wherein the curvature of the curved surface in the state of not making contact with the developing roller 3*d* hardly changes, i.e., contact is made so as to maintain the curvature thereof.

Here, the point differing from the first embodiment is that there is no third contact portion deforming to make contact along the developing roller or an end face portion of the first contact portion elastically supported at the supporting unit, or an end face portion of the second contact portion.

Evaluation Method for Each Example and Comparative Example

Evaluation items a through e for determining the difference between the present invention and the comparative examples will be described.

Evaluation Item a—Contact Pressure Stability Evaluation of the Regulation Member The contact stability of the regulation member is evaluated with the standards below.

C: The state of the regulation member prior to assembling the developing roller is unstable and has a high assembly precision in order to obtain the desired contact pressure.

B: The state of the regulation member prior to assembling the developing roller is stable, but has a high assembly precision in order to obtain the desired contact pressure.

A: The state of the regulation member prior to assembling the developing roller is stable, and does not require a high assembly precision in order to obtain the desired contact pressure.

Evaluation Item b—Contact Pressure Stability Evaluation of a Regulation Member with a Smaller Apparatus The contact stability of the regulation member, with a smaller developing device, is evaluated with the standards below.

C: A high assembly precision of greater than evaluation item a is required with a smaller apparatus.

A: The same assembly as with evaluation item a is employed with a smaller apparatus.

Evaluation Item c—Longitudinal Concentration Unevenness after Durability Test

Image evaluation is made by outputting a solid image for printing black on the entire surface and viewing whether or not there is concentration unevenness in a vertical band stretching in the perpendicular direction as to the lengthwise direction (laser main scanning direction)

C: Five or more bands of concentration unevenness are observed.

B: Two or more, but less than five, bands of concentration unevenness are observed.

A: One or less band of concentration unevenness is observed.

The longitudinal concentration unevenness evaluation is performed after test printing 4000 sheets. The test printing is performed by continuously feeding sheets with a recorded image of vertical lines with an image ratio of 5%.

The evaluation results of the first through third embodiments and the comparative examples 1 through 4 are shown in Table 1.

TABLE 1

| | A. Contact pressure stability of regulation member | B. Contact pressure stability of regulation member with smaller apparatus | C. Longitudinal concentration unevenness |
|---|---|---|---|
| First embodiment | A | A | A |
| Second embodiment | A | A | B |
| Third embodiment | A | A | B |

TABLE 1-continued

| | A. Contact pressure stability of regulation member | B. Contact pressure stability of regulation member with smaller apparatus | C. Longitudinal concentration unevenness |
|---|---|---|---|
| Comparative example 1 | A | C | C |
| Comparative example 2 | C | C | C |
| Comparative example 3 | C | C | C |
| Comparative example 4 | B | C | C |

First, the superiority as to comparative example 1 corresponding to the blade shaped toner regulation member will be described. Specifically, the first embodiment and comparative example 1 will be compared.

Figure 8:
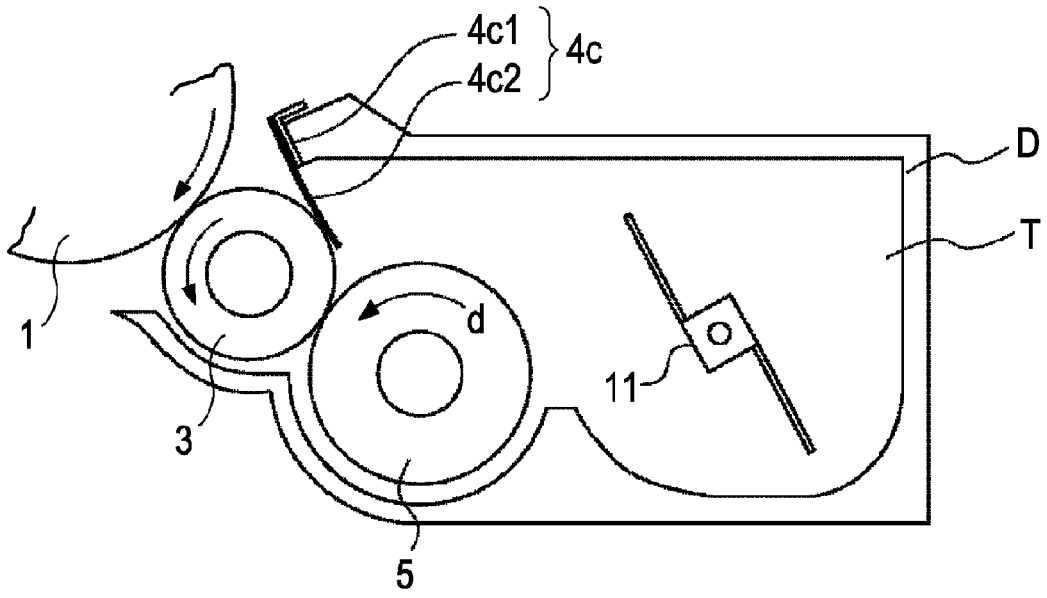
FIG. 8 PRIOR ART
FIG. 8 is a schematic diagram of the developing apparatus in a comparative example 1.

Comparative example 1 is a known blade-shaped toner regulation member as shown in FIG. 8. The feature thereof is that the thin plate elastic member is supported along one side in the longitudinal direction, and the underside of the thin plate elastic member makes contact with the developing roller 3. Undulation or the like may occur along the lengthwise direction due to glue unevenness at the fixing portion of the supporting portion supporting the one side and the thin plate elastic member. With the toner regulation member configuration in the comparative example 1, the contact width of the toner regulation member 4*c* and the developing roller 3 is small, and therefore due to the undulation, variances in the contact pressure in the longitudinal direction can occur easily.

Next, the problems with the smaller apparatus will be described. The comparative example 1 supports the thin plate elastic member on one side, and therefore along with an increased amount of pressing into the developing roller 3, the variance amount of the contact pressure to the toner regulation member increases. Heretofore, in order to minimize this variance, the distance from the supporting point wherein this plate has been supported along one side in the longitudinal direction to the contact point with the developing roller 3, i.e. the free length, must be secured so as to be sufficiently large, and the spring constant must be reduced. However, in the case of a smaller apparatus, the free length becomes shorter, and therefore the spring constant increases. Consequently, even when the toner regulation member varies in setting location only by a small amount, the contact pressure varies widely. That is to say, with a smaller apparatus, a predetermined stable contact pressure is difficult to obtain.

Further, due to the spring constant increasing, the influence of the lengthwise contact pressure unevenness from undulation or the like along the lengthwise direction as described above increases significantly, and lengthwise unevenness of the image concentration occurs more readily. That is to say, with a smaller apparatus, in order to obtain a predetermined stable contact pressure, an extremely highly precise assembly becomes necessary.

Additionally, making a smaller apparatus with the image forming apparatus A with a method for lining up the four color process cartridges in a row of four as shown in FIG. 2 and forming a full-color image at once is more difficult. This is because the position of the toner regulation member influences the spacing between the adjacent process cartridges greatly. Specifically, a disposal configuration wherein each of the processes of charging, exposure, and developing are not hindered is required. Further, a high disposal configuration for the developing unit is required due to the influences from the agitating, circulation, gravity, and so forth which accompany toner transporting.

However, in order to obtain the desired contact pressure in the comparative example 1, the distance from the supporting point supporting the thin plate on one side to the contact point with the developing roller 3, i.e. the free length, is secured, and keeping the spring constant to a small number is required. That is to say, in addition to the requirement for the above-described high disposition configuration, an even higher requirement for securing a free length occurs, and so making the color image forming apparatus A in FIG. 2 to be smaller is difficult.

Conversely, with the sheet member in the present first through third embodiments, the sheet member is formed into a U-shape by being bent in the widthwise direction along the lengthwise direction as to the recessed portion of the holding member 42 which is built into the developer container. Further, the regulation member 40 makes contact with the inner wall of the recessed portion of the holding member 42 by forming a flat surface at the first flat surface portion 47*a*. Thus, the elastic force F-1 of the regulation member 40 which attempts to revert back from the state in which the regulation member 40 is bent in the widthwise direction along the lengthwise direction is sufficiently working. Consequently, a U-shape can be maintained in a stable manner, even in the event that the developing roller is not in contact, and so the regulation member can be easily assembled.

Further, the sheet member is deformed along the circumferential surface of the developing roller at the third contact portion 46, which is a contact portion with the developing roller, so as to decrease the volume of the space 8 on the inner side of the U-shape formed by the sheet member. Therefore, the contact width of the sheet member and developing roller, i.e. a sufficient width for contact, can be secured. Consequently, contact between the regulation member 40 and the developing roller 3 can be performed in a stable manner. That is to say, by adjusting the size of the space portion and the thickness and hardness of the sheet member, a desired contact pressure for the spring constant of the contact pressure can be obtained in a stable manner. Additionally, since a predetermined free length as with the regulation member in the comparative example 1 is not necessary, the desired contact pressure can be easily obtained.

Also, when the developing roller 3 is pressed into the regulation member 40 supported in a U-shape, the end face 47*b* of the first contact portion securely makes contact with the recessed portion inner wall face bottom 42*a* of the sheet holding member, and is regulated to a predetermined position. In other words, if the width of the sheet member in the widthwise direction, the width of the recessed portion of the sheet holding member 42, and the distance between the developing roller 3 and the recessed portion inner wall face bottom of the sheet holding member 42 are determined, the contact position can be determined in a sure manner. Therefore, a regulation member can be easily assembled without need for highly precise adjustments. Thus, with the regulation member 40, the configuration thereof is simple and the desired contact pressure can be easily obtained, and so unevenness of contact pressure in the lengthwise direction does not occur easily. Consequently, the density unevenness lengthwise of the image density which occurs easily with the regulation member of the comparative example 1 is prevented.

As described above, with the present embodiment, desired contact pressure can be easily obtained without requiring highly precise assembly. Particularly, unstable contact due to a shorter free length resulting from the reduced size as with the comparative example 1 does not happen with the present first embodiment. Consequently, desired contact pressure can be easily obtained without requiring highly precise assembly. Further, even with a reduced size, the desired contact pressure can be maintained over the entire length in a stable manner, and the lengthwise unevenness of the image density is suppressed.

Additionally, even with the image forming apparatus A, where the four color processing cartridges are lined up in a row of four as shown in FIG. 2, and a full-color image is formed all at once, the degree of freedom of disposal of the sheet member is improved, and so is extremely advantageous as to size reduction.

Superiority as to the Comparative Examples

Next, the superiority of the present invention will be described by comparing the first embodiment and the comparative examples 2 through 4.

Stability evaluation results of regulation member contact pressure and stability evaluation results of regulation member contact pressure with size reduction First, stability evaluation of the contact pressure of the regulation member will be described. With the first embodiment, the stability thereof is favorable, regardless of the size of the developing unit. On the other hand, with the comparative example 2, the contact stability is poor, regardless of the size of the developing unit.

The regulation member of the comparative example 2 as shown in FIG. 9 does not regulate the side faces on the end portions in the widthwise direction of the sheet member when holding the sheet member in a U-shape, but rather fixes the end faces of the sheet member in the widthwise direction by gluing. With this configuration, the state of the sheet member is changed along with the rotation of the developing roller, and so predetermined contact pressure cannot be obtained. The reason for the state of the sheet member changing will be described below.

Figure 9B:
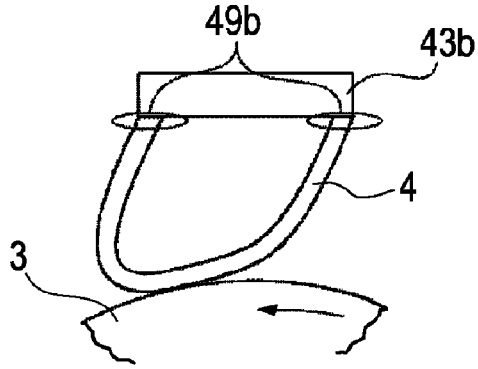

The third contact portion 46 wherein the sheet member and the developing roller make contact is subjected to frictional force in the circumferential direction along with the rotation of the developing roller. The sheet member attempts to deform at the downstream side of the developing roller rotational direction from this frictional force. With the comparative example 2, as shown in FIG. 9B, the sheet member has no supporting member to regulate the sheet member attempting to deform at the downstream side of the developing roller rotational direction, and therefore the sheet member cannot maintain the state thereof at which the developing roller is stopped, and the sheet member collapses.

On the other hand, as shown in FIG. 6A, the first embodiment has a sheet holding member as a supporting portion for regulating the regulation member 40 from collapsing. The collapsing of the sheet member is thus suppressed. Consequently, contact with the developing roller can be made in a stable manner.

Next, the third and fourth comparative examples have somewhat less contact stability than the first embodiment. Both the third and fourth contact examples make contact with the developing roller so that the curvature of the curved portion when bending the sheet member before building into the developing roller does not deform. Therefore, the contact width between the developing roller is small.

When the contact width is small, highly precise assembly is required in order to obtain predetermined contact pressure. Also, contact pressure can easily vary in response to circumferential unevenness of the developing roller or changes to the diameter of the developing roller from temporal changes or environmental variations. Consequently, contact stability deteriorates somewhat. Also, with a smaller size of developing unit, the contact width becomes smaller, and so highly precise assembly becomes necessary. Additionally, the contact pressure variations as to the changes to the developing roller diameter also increase. Consequently, in the event of reducing size of the developing unit, contact stability decreases. Further, with the comparative example 3, the fixed support of the sheet member is fixedly supported only with the end face of the sheet member in the widthwise direction and the side face in the vicinity of the end face. Therefore, in a state wherein only the sheet member is built in and the developing roller is not built in, the fixed support of the sheet member becomes unstable, and so compared to the comparative example 4 a higher assembly precision is required.

On the other hand, with the first embodiment, the contact width between the regulation member 40 and the developing roller 3 can be secured to be sufficiently wide and in a stable manner, as shown in FIG. 6A. Therefore, regardless of the size of the developing unit, the contact width is favorable. The reason for being able to secure a sufficiently wide contact width is so that the regulation member 40 is deformed along the circumferential surface of the developing roller 3 when making contact with the developing roller 3 at the third contact portion 46. That is to say, contact is made so that the volume of the space 8 within the U-shape formed by the regulation member 40 decreases.

Further, the first embodiment is advantageous in that sufficient contact width can be maintained in a stable manner. The reason for this is that, by pressing the developing roller 3 in to the regulation member 40, contact is made in a sure manner with the recessed portion inner wall face bottom 42*a* of the holding member at the first contact portion end face 47*a*, and the position thereof is regulated to a predetermined position. Consequently, even if the regulation member 40 is deformed such a great amount that the regulation member 40 is deformed along the surface of the developing roller 3 at the third contact portion 46, the contact width can be secured in a stable manner.

Additionally, the arrangement has a holding member 42 which is a supporting portion for regulating sheet collapse on the downstream side as to the rotation of the developing roller 3. Therefore, even if the regulation member 40 is deformed such a great amount that the regulation member 40 is deformed along the surface of the developing roller 3 at the third contact portion 46, sheet collapse can be suppressed. Consequently, whether or not the developing roller 3 is rotating, contact to the developing roller 3 can be made in a stable manner.

Also, the regulation member 40 makes contact with the recessed portion inner wall of the holding member 42 at the first flat surface portion 47*a* in a planar form. Therefore, the elastic force F-1 is sufficiently at work, wherein the regulation member 40 attempts to revert back from the state in which the regulation member 40 is bent in the widthwise direction along the lengthwise direction. Therefore, a stable U-shape can be maintained even in a state wherein the developing roller is not in contact, thereby enabling easy assembly.

As described above, with the present embodiment, contact with the first flat surface portion 47*a*, secure contact with the first end face portion 47*b*, and suppression by the supporting portion on the downstream side of the developing roller 3 in the rotational direction thereof is performed. Thus, regardless of whether or not the developing roller 3 is rotating, even if the regulation member 40 is deformed along the surface of the developing roller 3, a contact state can be maintained in a stable manner, thereby easily securing sufficient contact width. Further, the desired contact pressure can be obtained with only a simple setting, and so a contact state can be maintained in a stable manner even if the size of the apparatus is reduced.

Lengthwise Density Unevenness Evaluation Results

Next, the lengthwise density unevenness evaluation will be described by comparing the first through third embodiments and the first through fourth comparative examples. In the first embodiment, lengthwise density unevenness is suppressed regardless of the size of the developing unit. On the other hand, with the second through fourth comparative examples, lengthwise density unevenness occurs. The regulation members in the second through fourth comparative examples fixedly support both ends of the sheet member in the widthwise direction. Consequently, influence by the contact pressure variations in the lengthwise direction by gluing unevenness and so forth readily occurs. Also, as described above, contact stability is deteriorated with the second through fourth comparative examples as compared to the first embodiment. Consequently, pressure variations can occur easily over the entire length of the developing roller.

On the other hand, as shown in FIG. 6A, with the first embodiment, the regulation member 40 makes contact with the recessed portion inner wall 48 of the sheet holding member 42 at the first flat surface portion 47*a* in a planar form. The elastic force F-1 is sufficiently at work, wherein the regulation member 40 attempts to revert back from the state in which the regulation member 40 is bent in the widthwise direction along the lengthwise direction, and therefore the regulation member 40 can be held in an unglued state. Consequently, since there is no glue unevenness, lengthwise density unevenness can be suppressed.

Also, with the first embodiment, the regulation member can be supported by the sheet holding member 42 in an unglued state, since a second flat surface portion 49*a* is formed at the second contact portion which is on the upstream side, and by the elastic force F-1 working, contact can be made in a stable manner. Thus, there is no glue unevenness, and therefore lengthwise density unevenness can be suppressed.

Also, with each of the second embodiment and third embodiment, a second contact portion is formed by gluing each of the upstream side and downstream side of the sheet widthwise direction of the developing roller 3 in the rotational direction thereof. However, regardless of only one end of the plate-shaped sheet being fixed in the comparative example 1, lengthwise density unevenness occurs more than with the second and third embodiments. The reason for the second and third embodiments suppressing lengthwise density unevenness more than with the comparative example 1 will be described with reference to FIG. 11. With the second and third embodiments, contact pressure can be maintained over the entire length, because contact width can be sufficiently secured, as described with regard to contact stability.

Figure 11A:
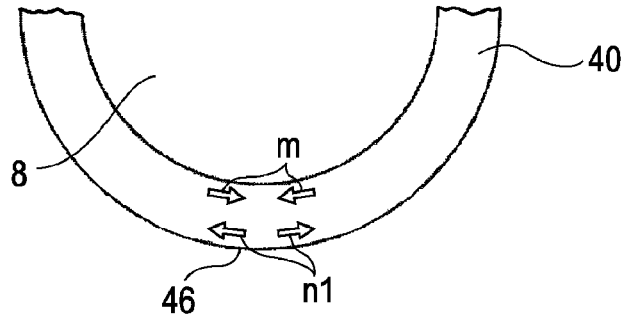
FIGS. 11A-11C are diagrams describing the extension of a bending portion of the toner regulation member and the mechanism of longitudinal irregularity occurring therein.
Figure 11B:
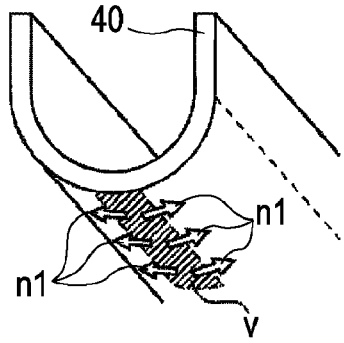
Figure 11C:
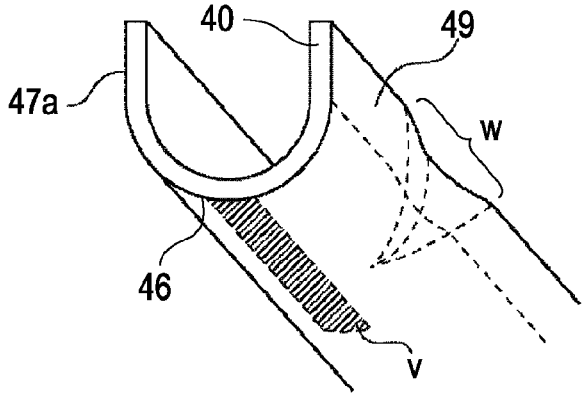

Further, the regulation member here holds the regulation member 40 in a U-shape and makes contact with the developing roller 3. In this event, with the regulation member 40 making up the U-shape, stretching n1 in the contact face side, and shrinkage m on the space 8 face side, occurs at the bending portion as shown in FIG. 11A. From this stretching n1 occurring, a smooth portion v is easily generated over the entire length, as shown in FIG. 11B. Therefore, as shown in FIG. 11C, undulation w resulting from the gluing unevenness at the second contact portion 49 which fixedly supports the regulation member 40 occurs. However, the undulation gradually eases before arriving at the smooth portion v because of the stretching n1 occurring at the bending portion, thus preventing the undulations w from being transmitted to the smooth portion v. In other words, the smooth portion v is easy to maintain, and therefore the contact pressure unevenness at the third contact portion which makes contact with the developing roller can be eased and lengthwise density unevenness can also be suppressed. Further, the smooth portion v may be considered to be easily formed even with the first flat surface portion 47*a* which forms a flat surface portion to make contact. In order for a smoother portion v to be generated so as to ease the lengthwise unevenness w which occurs at the second contact portion 49 which is fixedly supported, easing in the lengthwise direction at the first contact portion 47 which is the other end of another sheet member not fixed with glue becomes necessary.

In order to hold the sheet member, holding without glue, or simple holding with a portion being affixed, is employed. Therefore, the lengthwise direction at the first contact portion 47 can be eased, and the smooth portion v can be formed effectively. Also, since the first contact portion flat surface portion forms a flat surface to make contact, a smooth portion v is generated in the lengthwise direction in the vicinity of the first contact portion flat surface portion. With the action thereof also, the smooth portion v can be formed effectively.

Further, with the third contact portion 46 which is a contact portion between the regulation member 40 and the developing roller 3, the regulation member 40 is deformed along the periphery surface of the developing roller so as to make contact thereto, so that the volume of the space 8 within in inside of the U-shape formed by the regulation member 40 decreases. Therefore, it may be the that the smooth portion v is more easily generated.

Figure 11D:
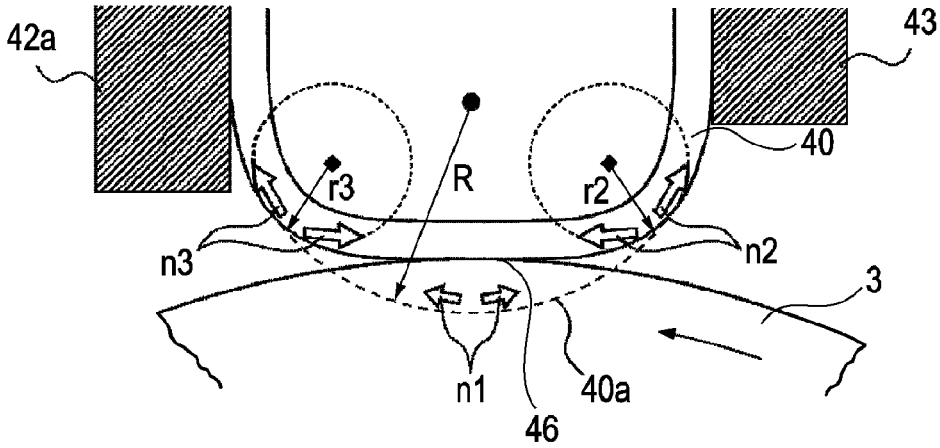

Specifics thereof will be described with reference to FIG. 11D, which is an enlarged view of the vicinity of the third contact portion 46 in a state wherein the developing roller 3 in the second embodiment has made contact. As shown in FIG. 11D, the regulation member 40 is pressed in along the developing roller periphery face so as to deform the flexible sheet. Subsequently, in both corners of the third contact portion 46, r2 and r3 which have a curvature smaller than the curvature R of the regulation member 40*a* in the state of not being in contact with the developing roller. Thus, stretching n2 and n3 occur, which are greater than the stretching n1 of the flexible sheet 40 in the state of not being in contact with the developing roller. Therefore, with the second contact portion 49 which is fixedly supported, even if undulations w from gluing unevenness or the like occur, the undulations are suppressed from being transmitted to the third contact portion due to the stretching n2 and n3. Consequently, lengthwise density unevenness can be suppressed from occurring.

Figure 10C:
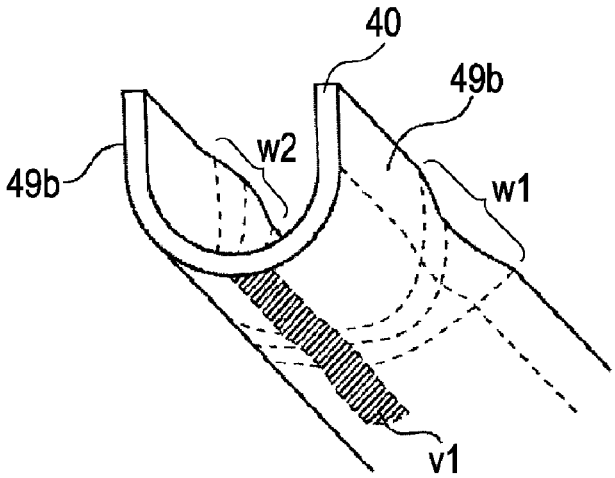

On the other hand, as with the comparative example 4 as shown in FIG. 10C, by fixing both end side faces in the widthwise direction of the sheet member with the fixing portion 49*b*, undulations w1 and w2 can more easily occur. In this state, even with stretching n1 working, an unsmooth face v1 is generated because the effects of smooth portion forming from the easing in the lengthwise direction of the first contact portion as described above cannot be obtained. In other words, with the comparative example 4, lengthwise unevenness of contact pressure easily occurs because the fixed faces which easily produce undulations increase to two, in addition to not being able to ease the undulations in the lengthwise direction.

Additionally, with the comparative example 4, the sheet member maintains the curvature in the state wherein the developing roller 3 is not making contact, and so there is not a large stretching on both corners of the contact portion with the developing roller 3. Consequently, effects of suppression of the undulations transmitting to the contact portion with the developing roller are not obtained, and so lengthwise density unevenness more easily occurs.

With the present embodiment, the contact width can be secured in a stable manner, and so the lengthwise density unevenness can be suppressed. Even if undulations occur from one end of the regulation member 40 being fixedly glued, the undulations of the gluing portion from the stretching of the bending portion of the U-shape is suppressed from transmitting to the third contact portion 46, so lengthwise density unevenness is suppressed. Also, the regulation member 40 can be held in a stable manner without gluing, the lengthwise density unevenness can be further suppressed. Additionally, the third contact portion 46 makes contact along the entire developing roller, thereby generating greater stretching on both corners of the third contact portion 46, thus suppressing the undulations at the glued portions from transmitting to the third contact portion 46, and suppressing lengthwise density unevenness.

Further, similar advantages to the present advantages can be seen with a reduced size developing unit. Holding member serving as supporting portion at downstream of contact position as to developing roller rotation The fourth through ninth embodiments will now be described in order to describe the advantages of the sheet holding member serving as a supporting portion downstream of the contact position as to the developing roller rotation.

Fourth through Ninth Embodiments

The present embodiments are basically the same as the first embodiment, but differ with regard to the points below.

As shown in FIG. 6B, as an extension of the first contact portion flat surface portion on the downstream side of the developing roller rotational direction, the distance h between the sheet holding member lower end edge portion P and the sleeve surface at the nearest proximity thereto is as follows: 3.2 mm for the fourth embodiment, 3.0 mm for the fifth embodiment, 2.7 mm for the sixth embodiment, 2.4 mm for the seventh embodiment, 1.0 mm for the eighth embodiment, and 0.8 mm for the ninth embodiment.

The comparison of h as to the curvature radius R in the state of the U-shaped form before the building in of the developing roller is 1.07 for the fourth embodiment, 1.00 for the fifth embodiment, 0.90 for the sixth embodiment, 0.80 for the seventh embodiment, 0.33 for the eighth embodiment, and 0.27 for the ninth embodiment. Since the width of the sheet holding member is 6.0 mm, the curvature radius is R=3.0 mm.

Also, the comparison of h as to the thickness t (=0.4 mm) of the sheet member is 8.0 for the fourth embodiment, 7.5 for the fifth embodiment, 6.8 for the sixth embodiment, 6.0 for the seventh embodiment, 2.5 for the eighth embodiment, and 2.0 for the ninth embodiment.

Evaluation Method

Fog after Durability Test

Fog is a sub-quality image feature manifested as background soiling wherein the toner is developed only a small amount on the white portion (unexposed portion) which is not to be printed.

Fog was measured as optical reflectivity from a green filter by an optical reflectivity measuring device (TC-6DS, manufactured by Tokyo Denshoku), reflectivity being obtained by subtracting this optical reflectivity from the reflectivity only from the recording paper, and thus evaluated as fog amount.

The amount of fog was obtained by measuring 10 items of recording paper and finding the mean value thereof.

$B^-$: Fog amount is from 1% to 2%

$B^+$: Fog amount is from 0.5% to 1%

A: Fog amount is less than 0.5%

The $B^-$ had no problems in actual use, but fog occurred at a level nearing the level of being problematic as a sub-quality image (3% or more fog). Also, $B^+$ was at a level wherein mild fog occurred, and A was at a level wherein virtually no fog occurred.

Evaluation was performed in an environment of 32.5° C. with 80% Rh. Evaluation of fog was performed after printing 4000 sheets. The printing test was performed by intermittently feeding paper through with a recording image of vertical lines of an image ratio of 5%. Intermittently means that after printing, and after time is passed in an awaiting state, the next printing is performed. Also, in the event that other image errors occurred, measurement was performed while avoiding that area, thus effort was made to evaluate the fog in a true manner.

Evaluation Results

The evaluation results of the first embodiment and the fourth through ninth embodiments are shown in Table 2 below.

TABLE 2

| | h (mm) | α (=h/R) | β (=h/t) | Fog Density |
|---|---|---|---|---|
| Fourth embodiment | 3.20 | 1.07 | 8.0 | $B^-$ |
| Fifth embodiment | 3.00 | 1.00 | 7.5 | $B^+$ |
| Sixth embodiment | 2.70 | 0.90 | 6.8 | $B^+$ |
| Seventh embodiment | 2.40 | 0.80 | 6.0 | A |
| First embodiment | 1.50 | 0.50 | 3.8 | A |
| Eighth embodiment | 1.00 | 0.33 | 2.5 | A |
| Ninth embodiment | 0.80 | 0.27 | 2.0 | A |

Density Evaluation Results of Fog after Durability Test

Figure 12:
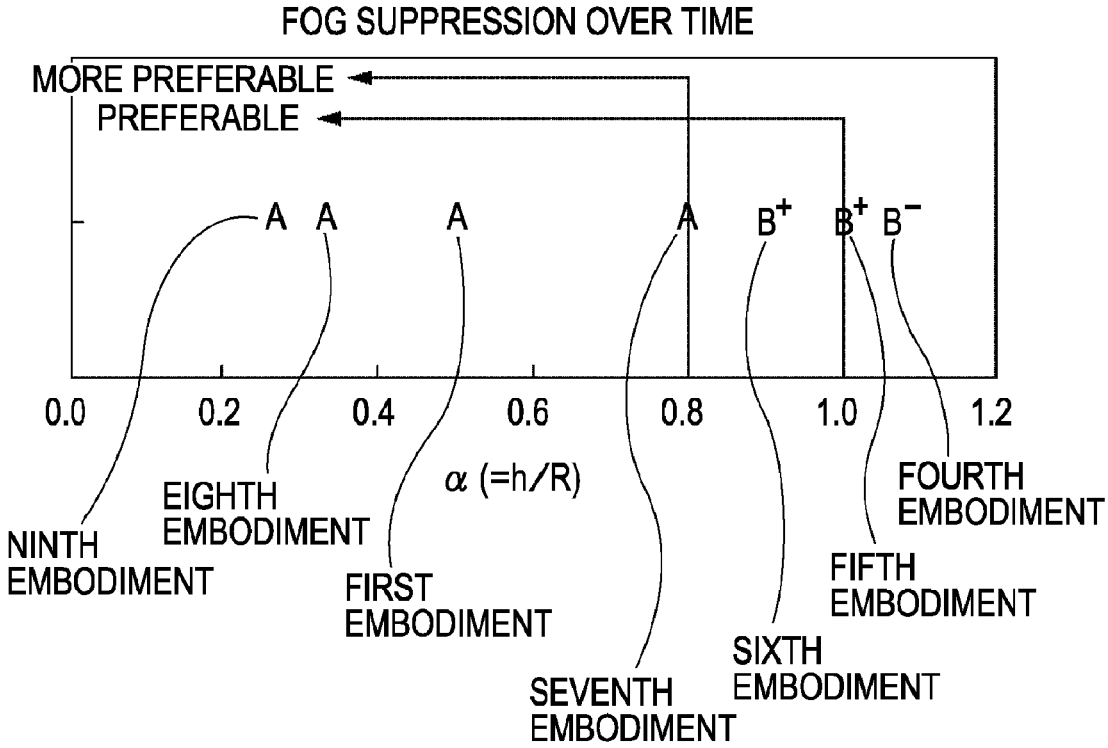
FIG. 12 shows the evaluation results of suppressing fog over time.

First, the results of the density of fog after durability test is shown in FIG. 12. With the first embodiment and the seventh through ninth embodiments, there was virtually no fog, and was thus favorable. On the other hand, with the fourth embodiment there was some fog although this did not cause problems during actual use, and with the fifth and sixth embodiments a small amount of fog occurred.

In other words, if the shortest distance h from point P at the edge lower end of the inner wall of the supporting member recessed portion 42 on the downstream side of the developing roller rotational direction to the surface of the developing roller changes, a change can be thought to occur to the support of the sheet member. The reason for this is described below.

Figure 13A:
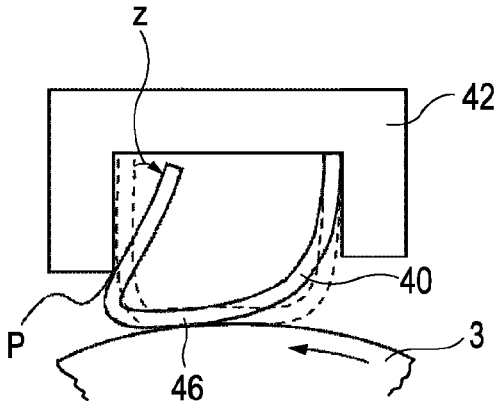
FIGS. 13A and 13B are diagrams describing the mechanism of toner regulation member failure occurring.
Figure 13B:
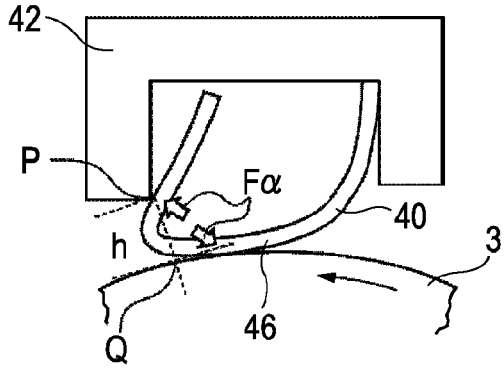

First, the state wherein collapse of the regulation member 40 occurred is shown in FIGS. 13A and 13B. As shown in FIG. 13A, the point P at the edge portion of the inner wall on the downstream side of the recessed portion of the holding member is used as the supporting point, whereby the downstream side portion of the regulation member 40 rotates. Thus, the edge face at the downstream side floats up, and collapse z occurs, thereby the regulation member 40 deforms as shown in FIGS. 13A and 13B.

As shown in FIG. 13B, the deformed regulation member 40 bends between the point P and the point Q which is positioned at the shortest distance of the sleeve surface from the point P, and therefore elastic force Fα occurs. The distance h between P and Q is small compared to the width of the supporting member inner wall, and therefore within the distance h between P and Q, the elastic force Fα in the state of the flexible sheet bending is an extremely large value. That is to say, the contact pressure of the third contact portion 46 increases as compared to the state wherein the flexible sheet does not collapse. Consequently, toner deterioration occurs at the third contact portion 46. When toner deterioration occurs, the toner obtaining the appropriate amount of charge becomes difficult. That is to say, toner having a small charge amount or charge with reverse polarity passes through the sheet member. When the toner in this state coats the developing roller and arrives at the developing unit, electrical control thereof becomes difficult, and the toner is transferred to the photosensitive drum. Consequently, sub-quality image due to fog occurs.

With the fourth embodiment, the relation between h and R as shown in FIG. 6B is h/R>1.0, i.e. h>R, and so the flexible sheet is thought to be easily collapsible with the point P of the edge portion of the recessed portion downstream side inner wall of the sheet holding member as the supporting point thereof. Specifically, the point P at the edge portion serving as the rotation fulcrum when collapse of the regulation member 40 occurs, and the sheet member, are set to make contact. Therefore, collapse with the point P of the edge portion as the supporting point occurs easily, as shown in FIG. 13A. Consequently, sub-quality image from fog is thought to occur from increased the third contact portion 46 contact pressure and increased toner deterioration.

The fifth and sixth embodiments have improved sub-quality image from fog as compared to the fourth embodiment. The point differing from the fourth embodiment is in that the relation between h and R and S is set within the range of $S<h\leqq R$, as shown in FIG. 6B. Therefore, the distance h between the point P of the edge portion of the recessed portion downstream side inner wall of the sheet holding member and the developing roller surface is reduced, so that the point P of the edge portion serving as the rotation fulcrum during collapse of the sheet member and the sheet member are not permitted to make contact. Thus, collapse of the sheet member can be prevented. Here, S denotes toner coat layer thickness, and h denotes a sufficiently large distance so as to not disrupt the toner coat layer.

Therefore, sub-quality images due to fog are suppressed as compared to the fourth embodiment. However, compared to the first and seventh through ninth embodiment, a small amount of sub-quality image occurs. The reason can be considered to be the following. With the present embodiments, the regulation member 40 is deformed along the entire surface of the developing roller 3 at the third contact portion 46. In other words, in the state wherein the regulation member 40 and the developing roller 3 are in contact, the curvature of the flexible sheet 40 in the state wherein the regulation member 40 and the developing roller 3 are not in contact is not maintained. Therefore, if the push-in amount of the developing roller is increased, both end portion side faces in the widthwise direction of the regulation member 40 spreads in the same direction as the elastic force, whereby the range of the holding member contacting the inner wall face spreads. Therefore, if the developing roller is pushed in, and the sheet member is in a state of being deformed, the point P of the edge portion serving as the rotational fulcrum during sheet member collapse, and the sheet member, can easily make contact. Consequently, a small amount of collapse occurs, which is thought to be the cause of sub-quality image due to fog.

On the other hand, with the first embodiment and the seventh through ninth embodiments, there are no sub-quality image features, and the image is thus favorable. With the first embodiment and the seventh through ninth embodiments, the relation between h, R, and S as shown in FIG. 6B are set such that $S<h\leqq 0.8\times R$. In other words, with the present embodiment, in a state wherein the developing roller 3 is pushed in and the sheet member is deformed, in order for the regulation member 40 to not make contact with the point P of the edge portion serving as the supporting point of collapse, $S<h\leqq 0.8\times R$ is thought to be required.

As described above, $S<h\leqq R$ is preferred in order to suppress collapse of the sheet member and to suppress sub-quality images due to fog after endurance. Also, $S<h\leqq 0.8\times R$ is preferred in order to suppress the collapse of the sheet member even if the flexible sheet deforms along the developing roller surface.

Also, with the ninth embodiment, even in a state wherein there is no toner coating the developing roller, the sheet member does not separate.

The reason thereof is that in the ninth embodiment, the relation between h and S and the thickness t of the regulation member 40 as shown in FIG. 6B are set within the range of $S<h\leqq 2$ t. That is to say, the nearest distance between the downstream side inner wall of the sheet holding member 42 and the developing roller is at or below 2 t. Therefore, even if the regulation member 40 collapses, and even in a worst case wherein the regulation member adheres to itself and becomes folded over, the thickness thereof is 2 t, and therefore can pass through the nearest distance h, and the regulation member 40 will not come apart in the downstream side of the developing roller rotational direction. Thus, even in a state wherein the toner is not adhered to the developing roller 3, the regulation member 40 can be prevented from coming apart. That is to say, if the toner is low and a state occurs wherein a portion of the surface of the developing roller 3 has no toner thereupon, friction increases, and collapse of the regulation member 40 occurs, the regulation member 40 is prevented from coming apart from the sheet holding member 42, and so toner leakage can be prevented.

Second Embodiment

Figure 4:
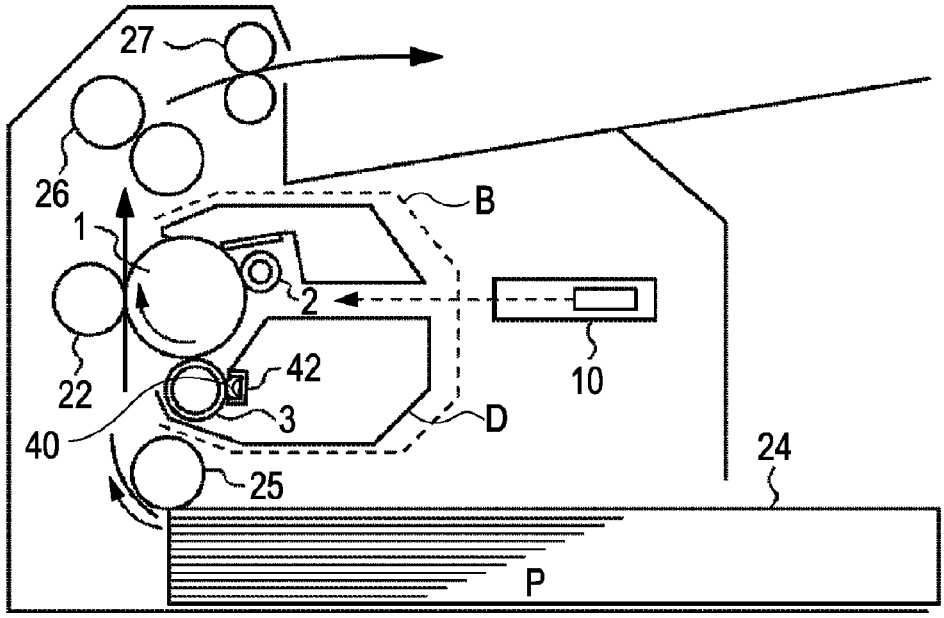
FIG. 4 is a schematic diagram of an image forming apparatus main unit according to a second embodiment.
Figure 5:
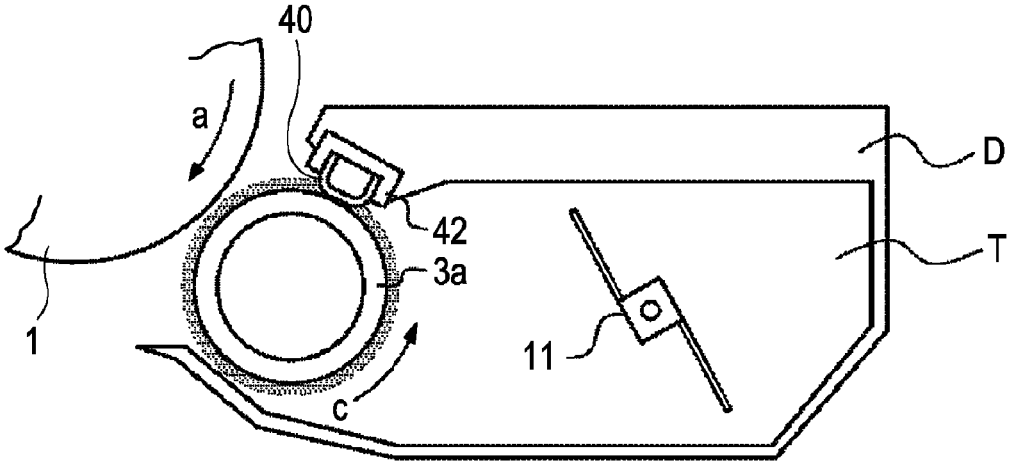
FIG. 5 is a schematic diagram of a developing apparatus according to the second embodiment.

FIG. 4 is a schematic configuration diagram showing an image forming apparatus according to the second embodiment employing the developing apparatus of the present invention, and is a cross-sectional diagram of a monochrome laser printer main unit. Also, FIG. 5 is a cross-sectional diagram of the developing apparatus employed for the monochrome laser printer.

With the present embodiment, a developing sleeve 3*a* is employed, which is a metal sleeve on which a conductive resin is coated, for a developer bearing member. Also, a fixed magnet roller 7 having a predetermined magnetic pole positioned on the inside of the developing sleeve 3*a* is provided. The magnetic toner on the inside of the developer container is pulled toward the surface of the developing sleeve 3*a* by the magnetic force of the magnet roller 7. The magnetic toner adhered to the surface of the developing sleeve 3*a* is transported by the rotation of the developing sleeve 3*a* in the direction shown by the arrow c. However, in passing through the contact portion with the toner regulation member 4, a charged toner coat layer is formed after being subjected to frictional charge application under pressure, as well as being subjected to layering regulating.

With the present embodiment, a gap of 300 μm at the nearest point is maintained between the developing sleeve 3*a* and the photosensitive drum 1. Also, a DC bias of −350 V and an AC bias of a rectangular waveform of 2400 Hz and 1600 Vpp are applied to the developing sleeve 3*a*. As with the first embodiment an electrostatic image of Vd=−550 V, V1=−100 V is formed on the photosensitive drum 1. Then the magnetic toner having been subjected to negative frictional charge on the developing sleeve 3*a* forms a toner image on the photosensitive drum 1 by operating back and forth between the photosensitive drum 1 and the developing unit in the vicinity of the developing sleeve 3*a*, with the AC bias. Note that the magnet roller within the developing sleeve 3*a* has a magnetic pole provided in the vicinity of the developing unit. With the present embodiment, the toner having an inappropriate charge can be suppressed from flying erroneously to the Vd portion by having a magnetic force of 800 G at the surface of the developing sleeve 3*a*, such as which cannot be controlled with the above-described potential setting.

A situation employing the present invention according to the second embodiment will be described below.

Tenth Embodiment

The present embodiment is an embodiment employing the sheet member used in the first embodiment with application to the developing apparatus described in the second embodiment.

COMPARATIVE EXAMPLE 5

Figure 14:
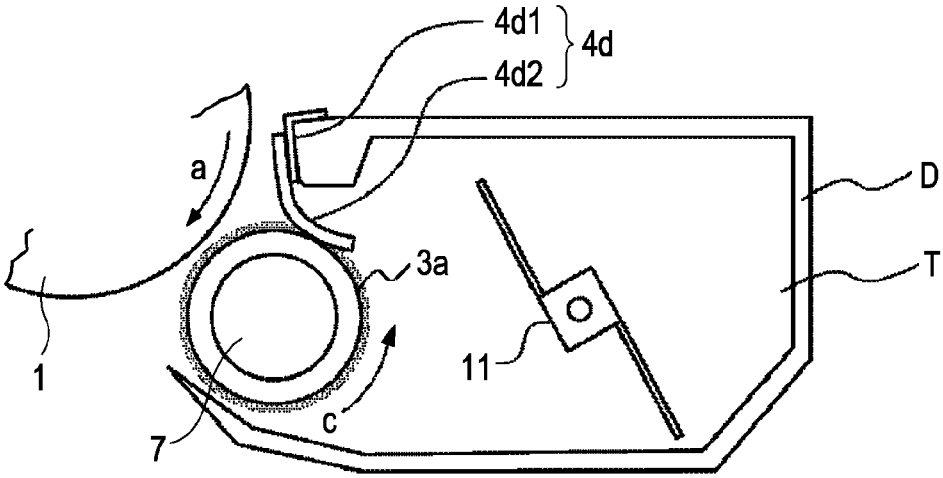
FIG. 14 is a schematic diagram of the developing apparatus in a comparative example 5.

The present comparative example (FIG. 14) applies the toner regulation member to be described below as to the developing apparatus described with the second embodiment. The toner regulation member 4*d* in the present comparative example is arranged such that a supporting plate 4*d*1 which is fixed to the developer container supports a rubber member 4*d*2 such as a urethane rubber along one side in the longitudinal direction and the underside of the facing portion thereof makes contact as to the developing sleeve. With the present comparative example, an iron plate with a thickness of 1.2 mm is employed for the supporting plate, and a urethane rubber plate with a thickness of 0.9 mm adheres to the supporting plate. The distance from the supporting portion along one side in the longitudinal direction of the urethane rubber plate to the contact portion with the developing sleeve, i.e. the free length, is 6.5 mm, and the amount for the developing sleeve to press in on the urethane rubber is 3.1 mm.

The advantages for applying the present invention to the first embodiment can be sufficiently obtained with the second embodiment as well. The advantages of the present invention with the second embodiment will be described below by comparing the tenth embodiment and the comparative example 5.

First, an image evaluation is performed of a solid black image in the environment of 32.5 C and 80% Rh, after the first 100 sheets have been printed and after 10 months have passed with no printing therewith. The printing test is performed by continuously feeding the recording paper with vertical lines with an image ratio of 5%. With the comparative example 5, sub-quality image had occurred at both end portions as to the lengthwise direction (primary scanning direction of laser) from density reduction. Whereas with the tenth embodiment, there was no density reduction at both end portions of the solid black image, and the image was favorable. The reason thereof will be described below.

The toner regulation member 4*d* of the comparative example 5 makes contact to the developing sleeve 3*a* in the state wherein a rubber sheet is supported along one side in the longitudinal direction. If the rubber sheet is maintained for a long period of time in the state of being deformed, so-called creeping can occur, wherein reverting back to the state before the deforming becomes difficult. In other words, in the case that the elastic force before the long period of time of disuse decreases from creeping after a long period of time of disuse, particularly in the case that the rubber sheet is supported along one side in the longitudinal direction as with the comparative example 5, the contact pressure at both end portions of the contact portion decreases. Also, since the contact width wherein the rubber sheet 4*d*2 and the developing sleeve 3*a* make contact is small, the influences of the contact pressure variations can be easily be effected in the comparative example 5. Consequently, on both end portions, maintaining the desired contact pressure becomes difficult, appropriate charge cannot be applied, and density is thought to decrease at both end portions of the black solid image.

On the other hand, with the tenth embodiment, even if creeping occurs, both end portions of the sheet member in the widthwise direction are supported along the entire length thereof, and the regulation member 40 has a contact width so as to be deformed along the surface of the developing sleeve 3*a*, whereby the contact pressure at both end portions can be thought to be difficult to decrease. Consequently, even after a long period of time of disuse, a stable contact pressure can be obtained, and sub-quality image from density decrease at the end portion of a solid black image is suppressed.

Also, with the comparative example 5, highly precise settings have been necessary in the event of reducing the size of the developing unit. The reason thereof can be thought of as follows. In the case of employing a blade shaped regulation member for the toner regulation member 4*d*, the material used for the supporting member is generally iron, wherein the rigidity in order to support evenly in the lengthwise direction and the cost thereof has an excellent balance. However, in the event of reducing the size, this supporting member influences the magnetic force in the vicinity of the regulation member, since the supporting member is near the vicinity of the developing sleeve. Consequently, when the supporting plate shifts only a small amount, the toner regulation state changes as well, thereby requiring improved assembly precision.

On the other hand, with the tenth embodiment, by employing a non-magnetic material for the supporting member, the regulation member is not influenced by magnetic force even with a reduced size, thereby enabling the desired contact pressure to be obtained in a stable manner.

Third Embodiment

Configuration of Developing End Portion Sealing Member

Next, the configuration of a developing end portion sealing member 7 relating to the present invention will be described.

Figure 15:
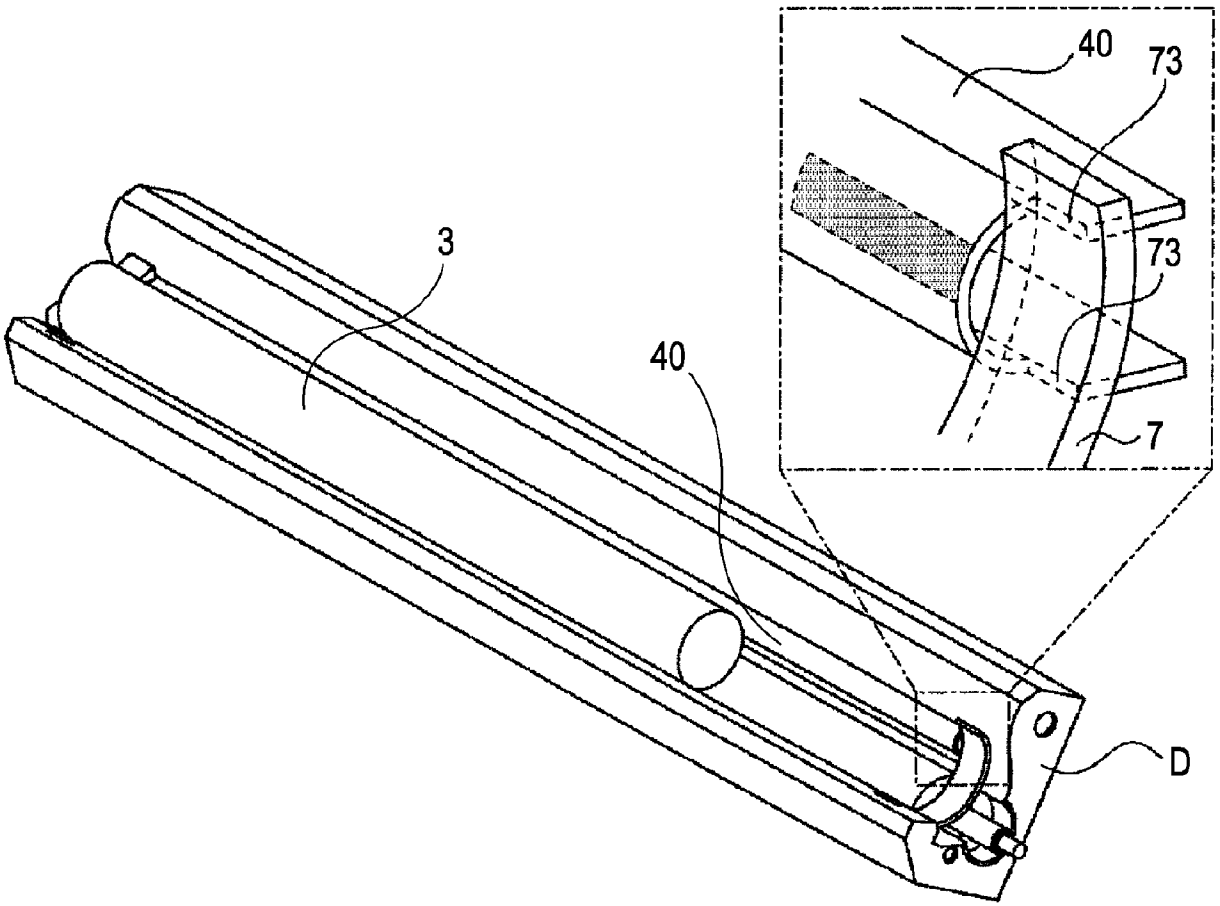
FIG. 15 is a perspective diagram of the main portions of the developing apparatus and a detail diagram of the vicinity of a sealing member of a developing edge portion, according to the third embodiment.

FIG. 15 is a perspective view of the primary portions of the developing apparatus and a detailed diagram of the vicinity of the developing end portion sealing member 7. A developing end portion sealing member 7 is provided on the outer side of a developing apparatus frame unit D to prevent toner leakage, on both ends of the developing roller 3 in the axial direction. The developing end portion sealing member 7 is formed as a felt pad or the like, and is glued onto the wall face provided at one portion of the developing apparatus frame unit D.

The developing end portion sealing member 7 is glued onto the wall face provided at one portion of the developing apparatus frame unit so as to have a fixed space between the periphery surface of the developing roller 3, whereby this space is set to be a thickness less than that of the developing end portion sealing member 7. Accordingly, the developing end portion sealing member 7 is compressed between the developing roller 3 and the floor face of the developing apparatus frame unit wherein the developing end portion sealing member 7 is glued thereto, thereby preventing toner leakage.

Figure 16A:
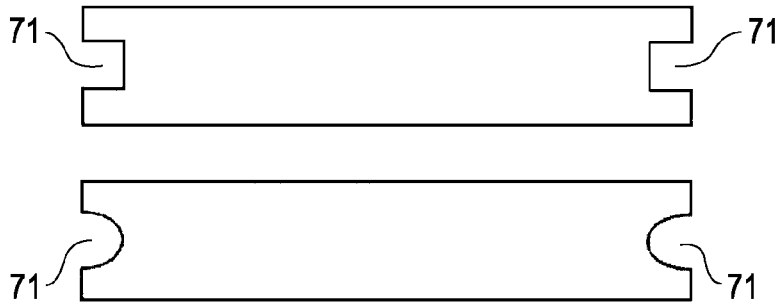
FIGS. 16A-16C are schematic diagrams of the vicinity of a sealing member of a developing edge portion, according to the third embodiment.
Figure 16B:
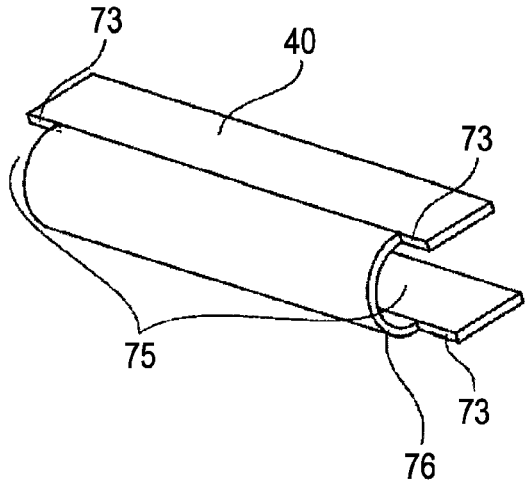
Figure 16C:
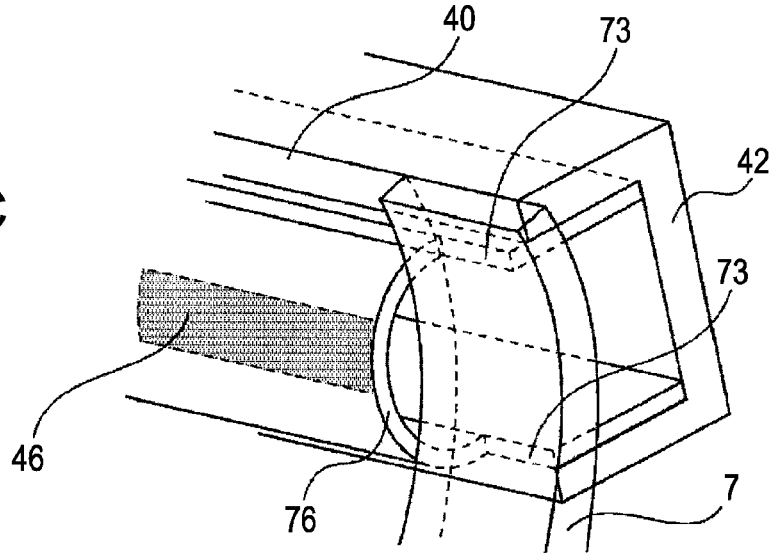

Incidentally with the present embodiment, the regulation member 40 having a flexible sheet shape has a recessed cutout portion 71 at both end portions in the lengthwise direction, as shown in the upper part of FIG. 16A. If the regulation member 40 having the above-described shape is bent in the widthwise direction along the entire lengthwise direction, a region 75 serving as an engaging portion wherein a curved portion is not formed, is formed at the cutout portion 71 at both end portions in the lengthwise direction, as shown in FIG. 16B. Thus, as shown in FIG. 16C, the developing end portion sealing member 7 is glued to the holding member 42 and the developing apparatus frame unit D (not shown) at the region 75 wherein the above-described curved portion is formed.

Now, the developing end portion sealing member 7 is disposed so as to make contact with a lengthwise direction end face 76, which intersects with the third contact portion 46 of the regulation member 40. Therefore, no distortion occurs on the surface (third contact portion 46) of the curved portion which makes contact with the developing roller 3. Consequently, sub-quality toner coating on the developing roller 3 can be prevented by effects from the surface (third contact portion 46) of the curved portion which makes contact with the developing roller 3.

Also, in order for distortion at the curved portion of the regulation member 40 not to occur, toner leakage is suppressed from the space where distortion is occurring.

Also, the developing end portion sealing member 7 is disposed so as to make contact with the lengthwise direction end face 76 which intersects with the third contact portion of the regulation member 40. Therefore, movement of the regulation member 40 in the lengthwise direction is regulated.

That is to say, the developing end portion sealing member 7 also performs position-determining of the regulation member 40 in the lengthwise direction. Therefore, regardless of whether the regulation member 40 is glued to or not glued to the holding member 42, position shifting by the regulation member 40 toward one side in the lengthwise direction by endurance variations and so forth can be prevented. Consequently, a space developing between the end portion in the lengthwise direction of the regulation member 40 and the developing end portion sealing member 7 is prevented. That is to say, toner leakage from the end portions can be suppressed in a stable manner over time, while maintaining contact stability in the lengthwise direction.

Also, with the present embodiment, the developing end portion sealing member 7 presses the regulation member 40 in the same direction as the pressing direction of the developing roller 3, at the engaging portion 73 formed by providing a recessed cutout portion in the regulation member 40. Thus, the regulation member 40 can be suppressed from coming apart from the holding member 42, and toner leakage can be prevented. Further, main unit malfunction, such as the regulation member 40 coming apart, and wrapping around a fusing portion via a transfer portion and so forth, is suppressed.

Note that similar advantages can be obtained with the cutout portion 71 in a form such as that shown in the lower part of FIG. 16A.

COMPARATIVE EXAMPLE 6

Figure 18:
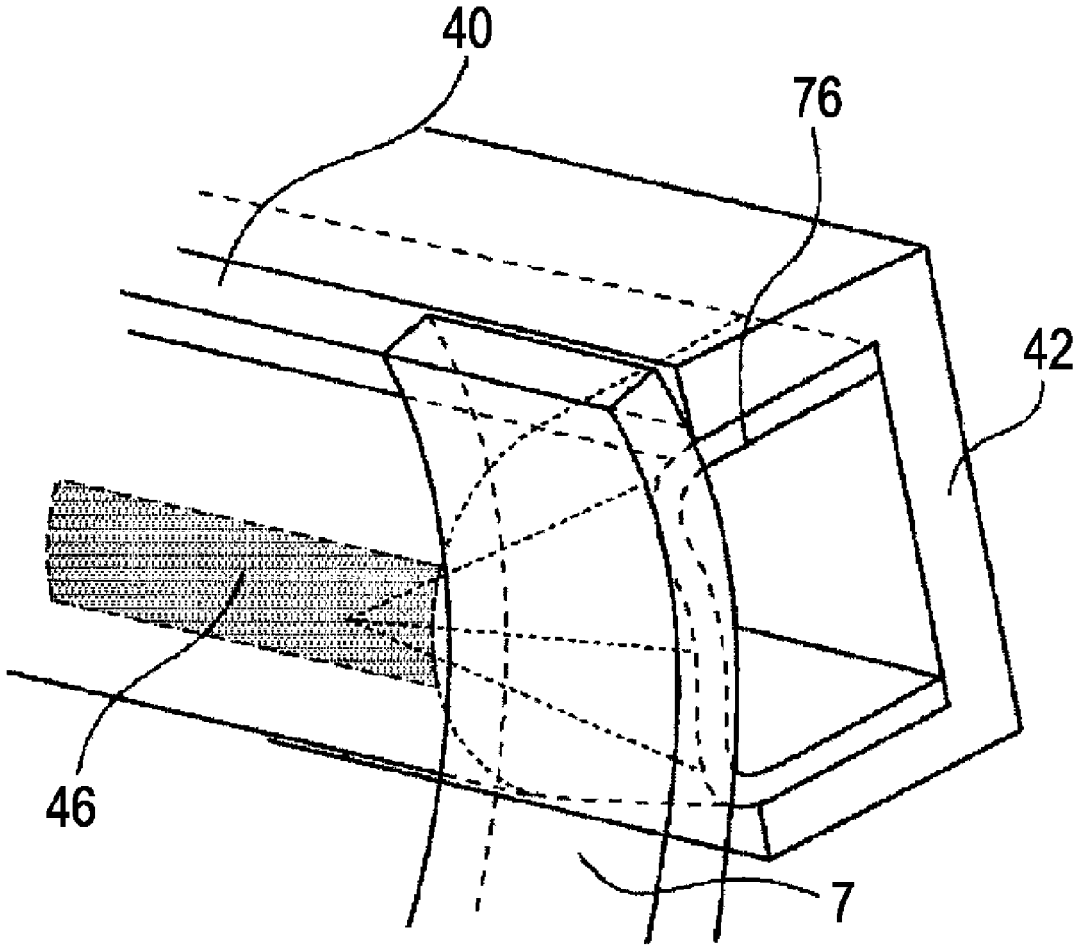
FIG. 18 is a schematic diagram of the vicinity of a sealing member of a developing edge portion, according to the comparative examples.

Here, a comparative example 6 is illustrated in FIG. 18 to describe the problem when the developing end portion sealing member 7 makes contact with the surface (third contact portion 46) of a curved portion making contact with the developing roller 3.

The developing apparatus of the present comparative example is basically similar to the developing apparatus described in the first embodiment, but differs by the points below. First, the regulation member 40 does not have a cutout portion as with the first embodiment. Further, at the lengthwise direction end portions of the third contact portion, the developing end portion sealing member 70 is pressed in the same direction as the direction for pressing in the developing roller 3, and set therein, to position the regulation member 40.

When the developing end portion sealing member 7 makes contact with the surface (third contact portion 46) of the curved portion of the regulation member 40, distortion occurs at the contact portion with the developing end portion sealing member 7 of the regulation member 40. This distortion exerts influence through to the contact region (third contact portion 46) between the developing roller 3 and the regulation member 40, whereby sub-quality toner coating occurs on the developing roller 3 from the above-mentioned distortion influence.

Further, the developing end portion sealing member 7 and the regulation member 40 cannot sufficiently adhere together due to the above-mentioned distortion. In other words, a space develops in the contact space between the developing end portion sealing member 7 and the distortion generating portion at the curved portion of the regulation member 40. Therefore, since sufficient adhering cannot be obtained in order to prevent toner leakage, toner leakage occurs from the end portions.

Also, as another modification example, the cutout shape at the lengthwise direction end portions of the regulation member 40 differs, as described above. A schematic diagram is shown in FIG. 7.

Figure 17A:
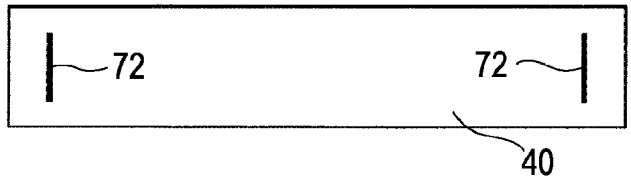
FIGS. 17A-17D are schematic diagrams of the vicinity of a sealing member of a developing edge portion, according to the third embodiment.
Figure 17B:
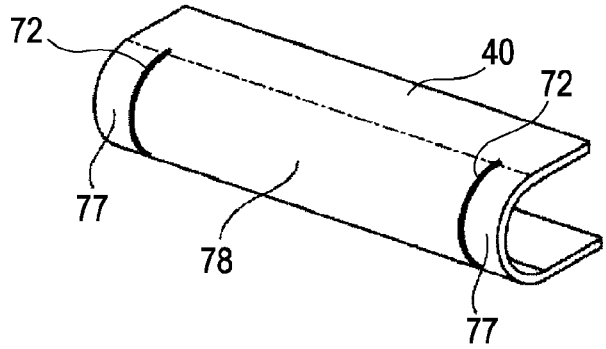

The regulation member 40 employed with the present embodiment has a cutout 72 in the lengthwise direction end portions, as shown in FIG. 17A. When the sheet having the above-mentioned shape is bent so that the widthwise direction is bend across the entire lengthwise direction, a curved portion is formed on the regulation member 40 as shown in FIG. 17B. Now, the regulation member 40 forms a curved portion at the curved portion 78 contact with developing roller 3 and the curved portions 77 at the lengthwise direction end portions, with the cutout in the lengthwise direction ends serving as a border.

Here, the developing end portion sealing member 7 is disposed so as to make contact with the lengthwise direction end face 76 which intersects with the third contact portion of the regulation member 40. Therefore, distortion does not occur at the surface (third contact portion 46) of the curved portion which makes contact with the developing roller 3. Consequently, sub-quality toner coating on the developing roller 3, which occurs from the influence of distortion at the surface (third contact portion 46) of the curved portion making contact with the developing roller 3, can be suppressed.

Also, in order to prevent distortion from occurring at the curved portion of the regulation member 40, toner leakage from the space at the distorted portion is suppressed.

Further, the developing end portion sealing member 7 is disposed so as to make contact with the lengthwise direction end face 76 which intersects with the third contact portion of the regulation member 40. Therefore, shifting of the regulation member 40 in the lengthwise direction is regulated. That is to say, the developing end portion sealing member 7 also performs position-determining of the regulation member 40 in the lengthwise direction. Therefore, regardless of whether the regulation member 40 is glued to or not glued to the holding member 42, position shifting by the regulation member 40 toward one side in the lengthwise direction by endurance variations and so forth can be prevented. Consequently, a space developing between the end portion in the lengthwise direction of the regulation member 40 and the developing end portion sealing member 7 is prevented. That is to say, toner leakage from the end portions can be suppressed in a stable manner over time, while maintaining contact stability in the lengthwise direction.

Figure 17C:
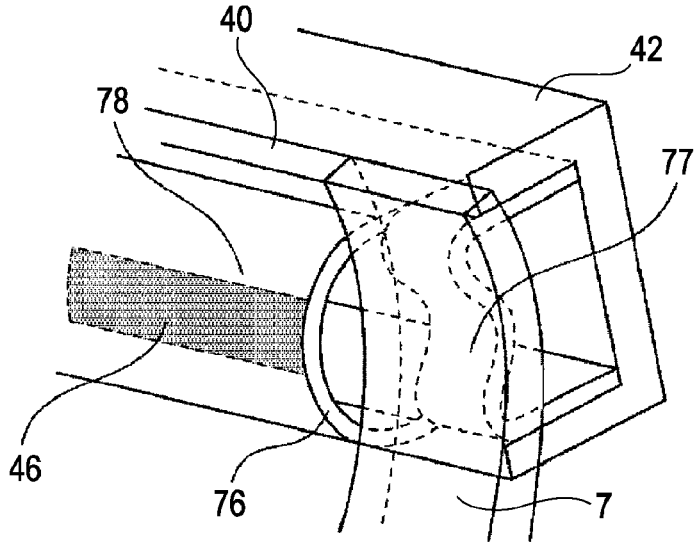

Now as shown in FIG. 17C, the developing end portion sealing member 7 is glued onto the developing apparatus frame unit D so as to compress the surface of the curved portion 77 at the lengthwise direction ends serving as an engaging portion. The developing end portion sealing member 7 presses the regulation member 40 in the same direction as the pressing direction of the developing roller 3 as to the supporting portion. Thus, the regulation member 40 can be suppressed from coming apart from the holding member 42, and toner leakage can be prevented. Further, main unit malfunction, such as the regulation member 40 coming apart, and wrapping around a fusing portion via a transfer portion and so forth, is suppressed.

Figure 17D:
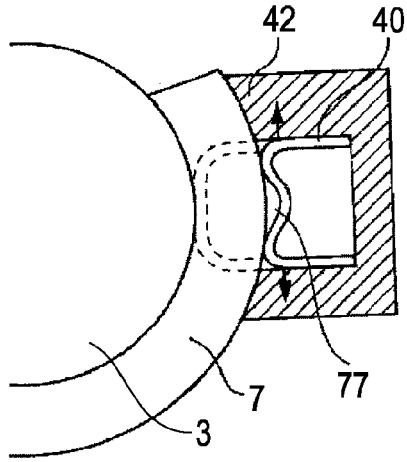

Also, the curved portion 77 of the lengthwise direction end portions are contained within the space portion in a buckled state, as shown in FIG. 17D. Note that FIG. 17D is a cross-sectional diagram around the regulation member 40 of the developing apparatus according to the present embodiment. The curved portion 77 at the lengthwise direction ends contained within the space portion is pushed in as to the recessed inner wall of the holding member 42, thereby elastic force is working. Consequently, the regulation member 40 is supported as to the holding member 42 with further stability. Therefore, shifting in the lengthwise direction can be suppressed.

A summary of the third embodiment will now be given. The developing end portion sealing member 7 is disposed so as to make contact with the lengthwise direction end face 76 which intersects with the third contact portion of the regulation member 40, and therefore no distortion occurs on the surface (third contact portion 46) of the curved portion which makes contact with the developing roller 3. Consequently, the sub-quality toner coating on the developing roller 3 which occurs from the distortion influence from the surface (third contact portion 46) of the curved portion which makes contact with the developing roller 3 can be suppressed.

In order to prevent distortion from occurring at the curved portion of the regulation member 40, toner leakage from the space at the distorted portion is suppressed.

The developing end portion sealing member 7 is disposed so as to make contact with the lengthwise direction end face 76 which intersects with the third contact portion of the regulation member 40. Therefore, shifting of the regulation member 40 in the lengthwise direction is regulated. That is to say, the developing end portion sealing member 7 also performs position-determining of the regulation member 40 in the lengthwise direction. Therefore, regardless of whether the regulation member 40 is glued to or not glued to the holding member 42, position shifting by the regulation member 40 toward one side in the lengthwise direction by endurance variations and so forth can be prevented. Consequently, a space developing between the end portion in the lengthwise direction of the regulation member 40 and the developing end portion sealing member 7 is prevented. That is to say, toner leakage from the end portions can be suppressed in a stable manner over time, while maintaining contact stability in the lengthwise direction.

The developing end portion sealing member 7 presses the regulation member 40 in the same direction as the pressing direction of the developing roller 3, at the engaging portion 73 formed by providing a recessed cutout portion in the regulation member 40. Thus, the regulation member 40 can be suppressed from coming apart from the holding member 42, and toner leakage can be prevented. Further, main unit malfunction, such as the regulation member 40 coming apart, and wrapping around a fusing portion via a transfer portion and so forth, is suppressed.

The curved portion 77 at the lengthwise direction ends contained within the space portion is pressed in as to the recessed portion inner wall of the holding member 42, and therefore elastic force works. That is to say, the regulation member 40 is held with further stability as to the holding member 42. Consequently, shifting in the lengthwise direction can be further suppressed.

As described above, according to the present invention, the regulation member can make contact with the developer bearing member in a stable manner. Also, position-determining can be easily performed of the regulation member in the lengthwise direction thereof. Further, assembly of the regulation member can be improved, and the size of the developing apparatus, processing cartridges, and image forming apparatus can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-173618 filed Jun. 23, 2006, No. 2006-173617 filed Jun. 23, 2006 and No. 2007-152702 filed Jun. 8, 2007, which are hereby incorporated by reference herein in their entirety.

What is claimed is:

1. A developing apparatus employed with an image forming apparatus, comprising:

a developer bearing member configured to bear developer for developing an electrostatic latent image formed on an image bearing member;

a supporting member supporting the developer bearing member; and a sheet-shaped regulation member making contact with the developer bearing member and configured to regulate the amount of developer borne by the developer bearing member, the sheet-shaped regulation member including:

a first contact portion supported at one end side in the width-wise direction of the sheet-shaped regulation member by the supporting member, the first contact portion having a flat surface portion and an end surface portion intersecting with the flat surface portion, a second contact portion supported by the supporting member at the other end side in the width-wise direction of the regulation member; and a third contact portion making contact with the developer bearing member between the first contact portion and the second contact portion in the width-wise direction of the regulation member, wherein the flat surface portion makes contact with and is supported by the supporting member by an elastic force generated by the regulation member being bent along the lengthwise direction of the regulation member, or by an elastic force generated by the third contact portion making contact with the developer bearing member, and wherein the end surface portion makes contact with and is supported by the supporting member by the force received from the developer bearing member by the third contact portion making contact with the developer bearing member.

2. The developing apparatus according to claim 1, wherein the second contact portion has a flat surface portion and an end surface which intersects with the flat surface portion, wherein the flat surface portion of the second contact portion makes contact with and is supported by the supporting member by an elastic force generated by the regulation member being bent along the lengthwise direction of the regulation member, or by an elastic force generated by the third contact portion making contact with the developer bearing member, and wherein the end surface portion of the second contact portion makes contact with and is supported by the supporting member by the force received from the developer bearing member by the third contact portion making contact with the developer bearing member.

3. The developing apparatus according to claim 1, wherein the second contact portion is affixed to the supporting portion at the upstream of the movement direction of the developer bearing member.

4. The developing apparatus according to claim 1, wherein, at the downstream side of the movement direction of the developer bearing member, the Expression (1)

$$S<h\leqq R \quad (1)$$

holds, and wherein (h) is the shortest distance between the supporting member which is closest to the third contact portion and the surface of the developer bearing member, (S) is the thickness of the developer layer regulated by the regulation member, and (R) is a curvature radius generated by the regulation member being bent along the lengthwise direction in a state of not being in contact with the developer bearing member.

5. The developing apparatus according to claim 1, wherein, at the downstream side of the movement direction of the developer bearing member, the Expression (2)

$$S<h\leqq 0.8\times R \quad (2)$$

holds, and wherein (h) is the shortest distance between the supporting member which is closest to the third contact portion and the surface of the developer bearing member, (S) is the thickness of the developer layer regulated by the regulation member, and (R) is a curvature radius generated by the regulation member being bent along the lengthwise direction in a state of not being in contact with the developer bearing member.

6. The developing apparatus according to claim 1, wherein, at the downstream side of the movement direction of the developer bearing member, the Expression (3)

$$S<h\leqq 2\times t \quad (3)$$

holds, and wherein (h) is the shortest distance between the supporting member which is closest to the third contact portion and the surface of the developer bearing member, (S) is the thickness of the developer layer regulated by the regulation member, and (t) is the thickness of the sheet-shaped regulation member.

7. The developing apparatus according to claim 1, wherein the developer includes a magnetic substance, the developer bearing member has a magnet therewithin, and the supporting member is made of a non-magnetic substance.

8. The developing apparatus according to claim 1, wherein the supporting member is provided as a part of a developer container forming the developing apparatus.

9. The developing apparatus according to claim 1, wherein the third contact portion modifies the shape thereof along the surface of the developer bearing member and makes contact thereto.

10. The developing apparatus according to claim 1, further comprising a sealing member provided on one end side and the other end side in the lengthwise direction of the developer bearing member, the sealing member preventing the developer from leaking to the outside of the developing apparatus, presses the regulation member onto the supporting member, and regulates the movement of the regulation member in the lengthwise direction thereof.

11. The developing apparatus according to claim 10, wherein the regulation member has a engaging portion including a recessed cutout portion on the one end side and the other end side formed by the regulation member being bent along the lengthwise direction, and wherein the regulation member is pressed onto the supporting member and the movement thereof is regulated in the lengthwise direction by the sealing member engaging with the engaging portion.

12. A processing cartridge detachably attached to an image forming apparatus, comprising:

an image bearing member;

a developer bearing member configured to bear the developer for developing an electrostatic latent image formed on an image bearing member;

a supporting member supporting the developer bearing member; and a sheet-shaped regulation member making contact with the developer bearing member and being configured to regulate the amount of developer borne by the developer bearing member, the sheet-shaped regulation member including:

a first contact portion which is supported at one end side in the width-wise direction of the regulation member by the supporting member, and the first contact portion having a flat surface portion and an end surface portion intersecting with the flat surface portion;

a second contact portion being supported by the supporting member at the other end side in the width-wise direction of the regulation member; and a third contact portion making contact with the developer bearing member between the first contact portion and the second contact portion in the width-wise direction of the regulation member, wherein the flat surface portion makes contact with and is supported by the supporting member by an elastic force generated by the regulation member being bent along the lengthwise direction of the regulation member, or by an elastic force generated by the third contact portion making contact with the developer bearing member, and wherein the end surface portion makes contact with and is supported by the supporting member by the force received from the developer bearing member by the third contact portion making contact with the developer bearing member.

13. The processing cartridge according to claim 12, wherein the second contact portion has a flat surface portion and an end surface which intersects with the flat surface portion, wherein the flat surface portion of the second contact portion makes contact with and is supported by the supporting member by an elastic force generated by the regulation member being bent along the lengthwise direction of the regulation member, or by an elastic force generated by the third contact portion making contact with the developer bearing member, and wherein the end surface portion of the second contact portion makes contact with and is supported by the supporting member by the force received from the developer bearing member by the third contact portion making contact with the developer bearing member.

14. The processing cartridge according to claim 12, wherein the second contact portion is affixed to the supporting portion at the upstream side of the movement direction of the developer bearing member.

15. The processing cartridge according to claim 12, wherein, at the downstream side of the movement direction of the developer bearing member, the Expression (1)

$$S<h\leqq R \quad (1)$$

holds, and wherein (h) is the shortest distance between the supporting member which is closest to the third contact portion and the surface of the developer bearing member, (S) is the thickness of the developer layer regulated by the regulation member, and (R) is a curvature radius generated by the regulation member being bent along the lengthwise direction in a state of not being in contact with the developer bearing member.

16. The processing cartridge according to claim 12, wherein, at the downstream side of the movement direction of the developer bearing member, the Expression (2)

$$S<h\leqq 0.8\times R \quad (2)$$

holds, and wherein (h) is the shortest distance between the supporting member which is closest to the third contact portion and the surface of the developer bearing member, (S) is the thickness of the developer layer regulated by the regulation member, and (R) is a curvature radius generated by the regulation member being bent along the lengthwise direction in a state of not being in contact with the developer bearing member.

17. The processing cartridge according to claim 12, wherein, at the downstream side of the movement direction of the developer bearing member, the Expression (3)

$$S<h\leqq 2\times t \quad (3)$$

holds, and wherein (h) is the shortest distance between the supporting member which is closest to the third contact portion and the surface of the developer bearing member, (S) is the thickness of the developer layer regulated by the regulation member, and (t) is the thickness of the sheet-shaped regulation member.

18. The processing cartridge according to claim 12, wherein the developer includes a magnetic substance, the developer bearing member has a magnet therewithin, and the supporting member is made of a non-magnetic substance.

19. The processing cartridge according to claim 12, wherein the supporting member is provided as a part of a developer container forming the processing cartridge.

20. The processing cartridge according to claim 12, wherein the third contact portion modifies the shape thereof along the surface of the developer bearing member and makes contact thereto.

21. The processing cartridge according to claim 12, further comprising a sealing member provided on one end side and the other end side in the lengthwise direction of the developer bearing member, the sealing member preventing the developer from leaking to the outside of the developing apparatus, presses the regulation member onto the supporting member, and regulates the movement of the regulation member in the lengthwise direction thereof.

22. The processing cartridge according to claim 21, wherein the regulation member has a engaging portion which is formed of a recessed cutout portion on the one end side and the other end side by the regulation member being bent along the lengthwise direction, and wherein the regulation member is pressed onto the supporting member and the movement thereof is regulated in the lengthwise direction by the sealing member engaging with the engaging portion.

23. An image forming apparatus configured to form an image on a recording medium, comprising:

an image bearing member;

a developer bearing member for configured to bear the developer for the purpose of developing an electrostatic latent image formed on the image bearing member;

a sheet-shaped regulation member making contact with the developer bearing member which is supported by a supporting member, configured to regulate the amount of developer borne by the developer bearing member, such sheet-shaped regulation member further including a first contact portion which is supported at one end side of the width-wise direction of the regulation member by the supporting member, and having a flat surface portion and an end surface portion intersecting with the flat surface portion, a second contact portion being supported by the supporting member at the other end side of the width-wise direction of the regulation member, and a third contact portion making contact with the developer bearing member between the first contact portion and the second contact portion in the width-wise direction of the regulation member; wherein the flat surface portion makes contact with and is supported by the supporting member by elastic force generated by the regulation member being bent along the lengthwise direction of the regulation member, or by elastic force generated by the third contact portion making contact with the developer bearing member; and wherein the end surface portion makes contact with and is supported by the supporting member by the force received from the developer bearing member by the third contact portion making contact with the developer bearing member.

24. The image forming apparatus configured to form an image on a recording medium according to claim 23, wherein;

the second contact portion has a flat surface portion and an end surface which intersects with the flat surface portion;

and wherein the flat surface portion makes contact with and is supported by the supporting member by elastic force generated by the regulation member being bent along the lengthwise direction of the regulation member, or by elastic force generated by the third contact portion making contact with the developer bearing member;

and wherein the end surface portion makes contact with and is supported by the supporting member by the force received from the developer bearing member by the third contact portion making contact with the developer bearing member.

25. The image forming apparatus configured to form an image on a recording medium according to claim 23, wherein the second contact portion is affixed to the supporting portion, at the upstream side of the movement direction of the developer bearing member.

26. The image forming apparatus configured to form an image on a recording medium according to claim 23, wherein, at the downstream side of the movement direction of the developer bearing member, the Expression (1)

$$S<h\leqq R \quad (1)$$

holds, wherein (h) is the shortest distance between the supporting member which is closest to the third contact portion and the surface of the developer bearing member, (S) is the thickness of the developer layer regulated by the regulation member is the to be S, and (R) is the curvature radius generated by the regulation member being bent along the lengthwise direction in a state of not being in contact with the developer bearing member.

27. The image forming apparatus configured to form an image on a recording medium according to claim 23, wherein, at the downstream side of the movement direction of the developer bearing member, the Expression (2)

$$S<h\leqq 0.8\times R \quad (2)$$

holds, wherein (h) is the shortest distance between the supporting member which is closest to the third contact portion and the surface of the developer bearing member, (S) is the thickness of the developer layer regulated by the regulation member, and (R) is the curvature radius generated by the regulation member being bent along the lengthwise direction in a state of not being in contact with the developer bearing member.

28. The image forming apparatus configured to form an image on a recording medium according to claim 23, wherein, at the downstream side of the movement direction of the developer bearing member, the Expression (3)

$$S<h\leqq 2\times t \quad (3)$$

holds, wherein (h) is the shortest distance between the supporting member which is closest to the third contact portion and the surface of the developer bearing member, (S) is the thickness of the developer layer regulated by the regulation member, and (t) is the thickness of the sheet-shaped regulation member.

29. The image forming apparatus configured to form an image on a recording medium according to claim 23, wherein the developer includes a magnetic substance, the developer bearing member has a magnet therewithin, and the supporting member is made of a non-magnetic substance.

30. The image forming apparatus configured to form an image on a recording medium according to claim 23, wherein the supporting member is provided as a part of a developer container forming the developing apparatus.

31. The image forming apparatus configured to form an image on a recording medium according to claim 23, wherein the third contact portion modifies the shape thereof along the surface of the developer bearing member and makes contact thereto.

32. The image forming apparatus configured to form an image on a recording medium according to claim 23, wherein the image forming apparatus has a sealing member which is a sealing member provided on one end side and the other end side of the lengthwise direction of the developer bearing member and prevents the developer from leaking to the outside of the developing apparatus, and which presses the regulation member onto the supporting member and also regulates the movement of the regulation member in the lengthwise direction thereof.

33. The image forming apparatus configured to form an image on a recording medium according to claim 23, wherein the regulation member has a engaging portion which is a recessed cutout portion on the one end side and the other end side formed by the regulation member being bent along the lengthwise direction, and the regulation member is pressed onto the supporting member and the movement thereof is regulated in the lengthwise direction by the sealing member engaging with the engaging portion.

* * * * *